US009044802B2

(12) United States Patent
Evans et al.

(10) Patent No.: US 9,044,802 B2
(45) Date of Patent: Jun. 2, 2015

(54) DYNAMIC LOAD EXPANSION TEST BENCH AND METHOD OF EXPANDING A TUBULAR

(75) Inventors: Merle E. Evans, Spring, TX (US); Richard W. DeLange, Kingwood, TX (US); John Richard Setterberg, Jr., Huntsville, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 609 days.

(21) Appl. No.: 12/748,046

(22) Filed: Mar. 26, 2010

(65) Prior Publication Data

US 2011/0232355 A1 Sep. 29, 2011

(51) Int. Cl.

*B21D 39/08* (2006.01)
*B21D 41/02* (2006.01)
*B21D 31/04* (2006.01)

(52) U.S. Cl.

CPC ..... *B21D 41/02* (2013.01); *B21D 31/04* (2013.01)

(58) Field of Classification Search

CPC ..... B21D 39/08; B21D 41/02; B21D 39/16; B21D 39/20; B21D 39/203; B21D 41/026; B21D 41/028; B21D 31/04

USPC ..... 72/370.06–370.08, 392, 393, 31.06, 57, 72/58, 283, 317, 367.1, 370.01, 72/370.22–370.24, 372; 425/392, 393; 166/207, 216

See application file for complete search history.

(56) References Cited

U.S. PATENT DOCUMENTS

| | | | | | |
|---|---|---|---|---|---|
| 788,119 | A | * | 4/1905 | Pope | 72/58 |
| 1,494,128 | A | * | 5/1924 | Primrose | 72/370.08 |
| 2,884,986 | A | * | 5/1959 | Heldenbrand | 72/302 |
| 2,893,460 | A | * | 7/1959 | Raynes | 72/20.1 |
| 2,896,445 | A | * | 7/1959 | McNabb | 73/49.6 |
| 2,907,202 | A | * | 10/1959 | McConnell | 73/49.6 |
| 2,919,741 | A | * | 1/1960 | Strock et al. | 72/305 |
| 3,243,986 | A | * | 4/1966 | Douthett et al. | 72/283 |
| 3,397,564 | A | * | 8/1968 | Schroeder | 72/113 |
| 3,495,301 | A | * | 2/1970 | Larsen et al. | 425/392 |
| 4,516,431 | A | * | 5/1985 | Heldenbrand | 73/826 |
| 5,210,932 | A | * | 5/1993 | Tokura | 29/727 |
| 5,388,440 | A | * | 2/1995 | Folmer | 72/62 |
| 5,471,857 | A | * | 12/1995 | Dickerson | 72/57 |
| 5,640,879 | A | * | 6/1997 | Damsohn et al. | 72/479 |
| 5,715,718 | A | * | 2/1998 | Rigsby et al. | 72/57 |
| 6,575,250 | B1 | * | 6/2003 | Wijsman | 166/380 |
| 6,578,630 | B2 | * | 6/2003 | Simpson et al. | 166/55.8 |
| 7,007,760 | B2 | * | 3/2006 | Lohbeck | 166/384 |
| 7,121,351 | B2 | * | 10/2006 | Luke et al. | 166/382 |
| 7,231,793 | B2 | * | 6/2007 | Sohn et al. | 72/61 |
| 7,269,986 | B2 | * | 9/2007 | Pfaffmann et al. | 72/60 |
| 7,380,429 | B1 | * | 6/2008 | Ghiran et al. | 72/58 |
| 7,739,917 | B2 | | 6/2010 | Shuster et al. | |
| 7,779,923 | B2 | * | 8/2010 | Holland et al. | 166/380 |
| 2003/0075337 | A1 | * | 4/2003 | Maguire | 166/380 |
| 2007/0000664 | A1 | * | 1/2007 | Ring et al. | 166/277 |
| 2010/0095736 | A1 | * | 4/2010 | Kolbe et al. | 72/370.08 |

FOREIGN PATENT DOCUMENTS

| | | | | |
|---|---|---|---|---|
| DE | 382645 | * | 10/1923 | B21D 41/02 |
| JP | 57031426 A | * | 2/1982 | B21D 39/08 |

OTHER PUBLICATIONS

Non-Patent Literature Search, Jan. 17, 2013, USPTO Scientific & Technical Information Center.*

Delange, R. W., Evans, M. E., Zhou, S., Choi, H. J., & Osburn, S. (Jan. 1, 2009). An Apparatus and Test Procedure for Qualifying Expandable Connections for Challenging Applications. Society of Petroleum Engineers. doi:10.2118/125667-MS.*

Terrell H. Expandable technology gains ground as a planned-in option. World Oil [serial online]. 2011:Available from: Business Insights: Essentials, Ipswich, MA. Accessed Sep. 18, 2014.*

Richard DeLange, Ghazi Hashem, Weatherford International Ltd, (Mar. 23, 2010). Dynamic load expansion test bench takes new approach to expandable connections testing. Drilling Contractor magazine, Mar./Apr. 2010 Issue.*

Push, Pull, Bend & Expand. (Jun. 2010) Weatherford's W Magazine, vol. 12, No. 2, pp. 8-11.*

* cited by examiner

*Primary Examiner* — Shelley Self
*Assistant Examiner* — Leonel Vasquez
(74) *Attorney, Agent, or Firm* — Patterson & Sheridan, L.L.P.

(57) ABSTRACT

A method and apparatus for a testing facility for simulating downhole conditions is provided. The testing facility may include a test bench for expanding tubular members having one or more threaded connections. The test bench may also be operable to simulate the expansion of a tubular connection downhole and to produce expanded tubular connection test samples.

44 Claims, 13 Drawing Sheets

DYNAMIC LOAD EXPANSION TEST BENCH AND METHOD OF EXPANDING A TUBULAR

BACKGROUND OF THE INVENTION

1. Field of the Invention

Embodiments of the invention relate to a testing facility for simulating downhole conditions. More particularly, embodiments relate to a test bench for expanding tubular members having one or more threaded connections. Embodiments of the invention further relate to a test bench for simulating the expansion of a tubular connection downhole and for producing expanded tubular connection test samples.

2. Description of the Related Art

Hydrocarbon and other wells are completed by forming a borehole in the earth and then lining the borehole with pipe or casing to form a wellbore. After a section of the wellbore is formed by drilling, a section of casing is lowered into the wellbore and temporarily hung therein from the surface of the well. Using apparatus and methods known in the art, the casing is cemented into the wellbore by circulating cement into the annular area defined between the outer wall of the casing and the borehole. The combination of cement and casing strengthens the wellbore and facilitates the isolation of certain areas of the formation behind the casing for the production of hydrocarbons.

Recent developments in the oil and gas exploration and extraction industries have included tubulars that are expandable downhole through the use of a cone or a swedge. Some expansion apparatus include expander tools with radially extendable members which, through fluid pressure from a run-in string, are urged outward radially from the body of the expander tool and into contact with a tubular wall. By rotating the expander tool in the wellbore and/or moving the expander tool axially in the wellbore with the extendable members actuated, a tubular can be expanded along a predetermined length.

The most challenging aspect of expanding strings of tubulars in a wellbore relates to the threaded connection between each joint of pipe. The threaded sections of the pin member and the box member are tapered and are typically formed directly into the ends of the tubular. The pin member includes helical threads extending along its length and terminates in a relatively thin "pin nose" portion. The box member includes helical threads that are shaped and sized to mate with the helical threads of the pin member during the make-up of the threaded connection. The threaded section of the pin member and the box member form a connection of a predetermined integrity intended to provide not only a mechanical connection but rigidity and fluid sealing. For example, at each end of the connection, a non-threaded portion of each piece often forms a metal-to-metal seal.

Threaded connections between expandable tubulars are difficult to successfully expand because of the axial bending (forces brought about as a tubular or connection wall is bent outwards) that takes place as an expansion member moves through the connection. For example, when a pin portion of a connector with outwardly facing threads is connected to a corresponding box portion of the connection having inwardly facing threads, the threads experience opposing forces during expansion. Typically, the outwardly facing threads will be in compression while the inwardly facing threads will be in tension. Thereafter, as the largest diameter portion of a conical expander tool moves through the connection, the forces are reversed, with the outwardly facing threads placed into tension and the inwardly facing threads in compression. The result is often a threaded connection that is loosened due to different forces acting upon the parts during expansion.

Another problem relates to "spring back" that can cause a return movement of the relatively thin pin nose. Typically, threaded connections on expandable strings are placed in a wellbore in a "pin up" orientation and then expanded from the bottom upwards towards the surface. In this manner, the pin nose is the last part of the connection to be expanded. While threaded connections might have a single set of threads between the two tubulars, many expandable connections include a "two-step" thread body with threads of different diameters and little or no taper. These types of connections suffer from the same problems as those with single threads when expanded by a conical shaped expander tool.

There are a number of ways to test expandable connections but most take place above ground with the connections held in a fixture and expansion tools forced through them. The problem with this type of test is that the stress load conditions present in a wellbore are not recreated. An expandable tubular string and the connections that make up the string experience different tension and compression loads along the length of the string when expanded in a vertical wellbore. The loading in the string varies because the weight of the string above and below the connections is different along the string length. For example, the connections at the top of the tubular string are loaded with a lesser amount of compression (weight thereabove) than the connections at the bottom of the tubular string, which are loaded with a greater amount of string weight from above. Because the expander typically supports the weight of the entire string, as the expander passes through a connection, the loading changes from compression to tension. The connections at the top of the tubular string are then loaded with a greater amount of tension than the connections at the bottom of the tubular string, which are loaded with a lesser amount of string weight hanging below. If the expander is being propelled with fluid pressure, the tension load is further increased due to an end thrust at the bottom of the tubular string from the applied pressure.

In one example, the expandable tubular string may be free hanging in a vertical wellbore via a work string. The tubular string may be supported near its lower end by an expander that is connected to the work string. In the unexpanded position, the portion of the tubular string above the expander is placed in compression under the weight of the string above the expander, and the portion of the tubular string below the expander is placed in tension from the weight of the string below the expander. Fluid communication through the lower end of the tubular string may be closed, and fluid pressure may be supplied through the work string to the lower end of the tubular string. The fluid pressure may pump the expander through the tubular string, as well as aid in expansion of the string. The thrust force of the fluid pressure necessary to move the expander through the tubular string will also place the portion of the tubular string below the expander in tension. Therefore, as the expander moves from the lower end of the tubular string to the upper end, the connections along the length of the string will experience a change in load from compression to tension. In addition, the overall length of the tubular string may shrink as it is expanded. The shortening of the tubular string at one end while the opposite end is fixed, a "fixed-free" configuration, may further vary the loads. In certain situations, however, the tubular string may be prevented from shortening in length, such that the string is fixed at its ends during expansion. This "fixed-fixed" configuration may even further vary the loads provided on the tubular string by an additional tension load. In some configurations, the tubular string may be set on the bottom of the wellbore and/or anchored to the wellbore at one or more locations, which further vary the loads experienced by the tubular string during expansion.

Therefore, there exists a need for a method and apparatus for simulating the downhole expansion a threaded tubular connection in a controlled laboratory environment. There also exists a need for a method and apparatus for testing the expansion of threaded tubular connection designs under various wellbore conditions. There further exists a need for a method and apparatus for producing threaded tubular connection test samples that accurately represent expansion under wellbore conditions.

SUMMARY OF THE INVENTION

Embodiments of the invention include a method of expanding a tubular. The method may include applying a pre-determined compression load to the tubular and applying a predetermined tension load to the tubular. The method may further include maintaining the pre-determined compression and tension loads while expanding a portion of the tubular.

Embodiments of the invention include a method of expanding a tubular. The method may include securing the tubular to a first actuation assembly and a second actuation assembly. The method may also include applying a compression load to the tubular using the first actuation assembly and applying a tension load to the tubular using the second actuation assembly. The method may further include maintaining the application of the compression and tension loads while expanding the tubular.

Embodiments of the invention include an apparatus for expanding a tubular having one or more connections. The apparatus may include a frame for supporting a first, second, and third crosshead. The apparatus may also include a first actuation assembly that is operable to move the first crosshead relative to at least one of the second and third crossheads. The first actuation assembly may also be operable to apply a first load to the tubular. The apparatus may further include a second actuation assembly that is operable to apply a second load to the tubular. The first load may be a compression load, and the second load may be a tension load. The compression and tension loads may be maintained using the first and second actuation assemblies while the tubular is being expanded.

Embodiments of the invention include a method of expanding a tubular. The method may include applying a compression load to the tubular and applying a tension load to the tubular. The method may also include moving the tubular relative to an expander to expand a portion of the tubular. The method may also include maintaining the compression and tension loads while the tubular is expanded.

Embodiments of the invention include a method of expanding a tubular comprising the steps of expanding one or more test samples of a tubular connection above ground; testing the test samples to define an operating envelope within which the tubular connection will operate without failure when expanded downhole; installing the tubular connection in a wellbore; and expanding the tubular connection in the wellbore while operating the tubular connection within the operating envelope defined by the testing of the test samples.

Embodiments of the invention include a method of expanding a tubular comprising the steps of applying a compression load to a first portion of the tubular, wherein the compression load is greater than a weight of the first portion of the tubular; applying a tension load to a second portion of the tubular; and expanding the first and second portions of the tubular while applying the compression and tension loads.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Embodiments of invention discussed herein include a method and apparatus for expanding a tubular connection above ground, while simulating virtually all downhole load conditions described above.

Figure 1:
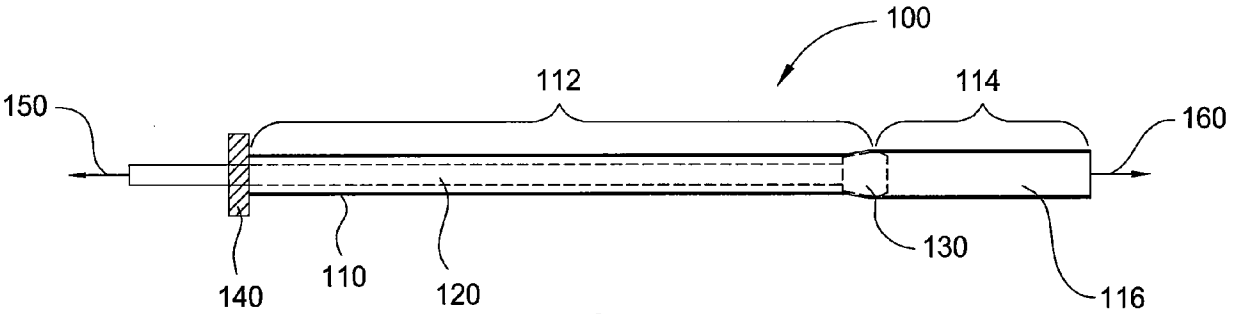
FIGS. 1, 2, and 3 illustrate embodiments of a test configuration for expanding a tubular connection.
Figure 2:
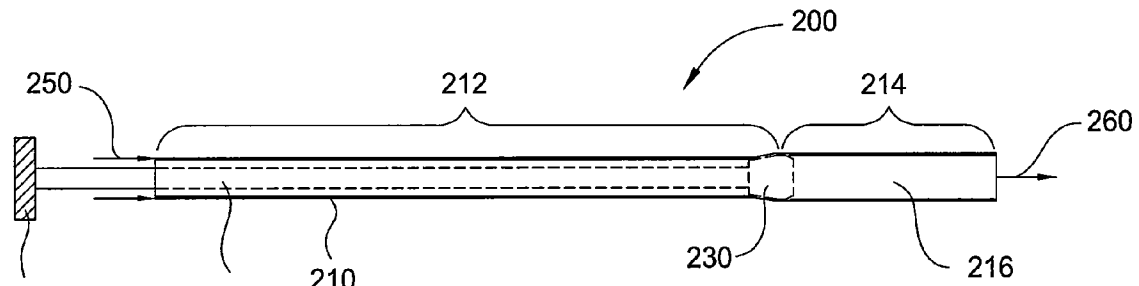
Figure 3:
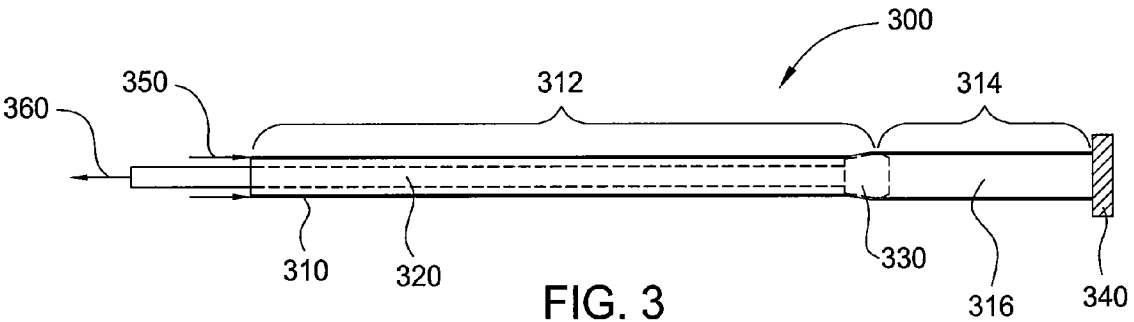
Figure 8:
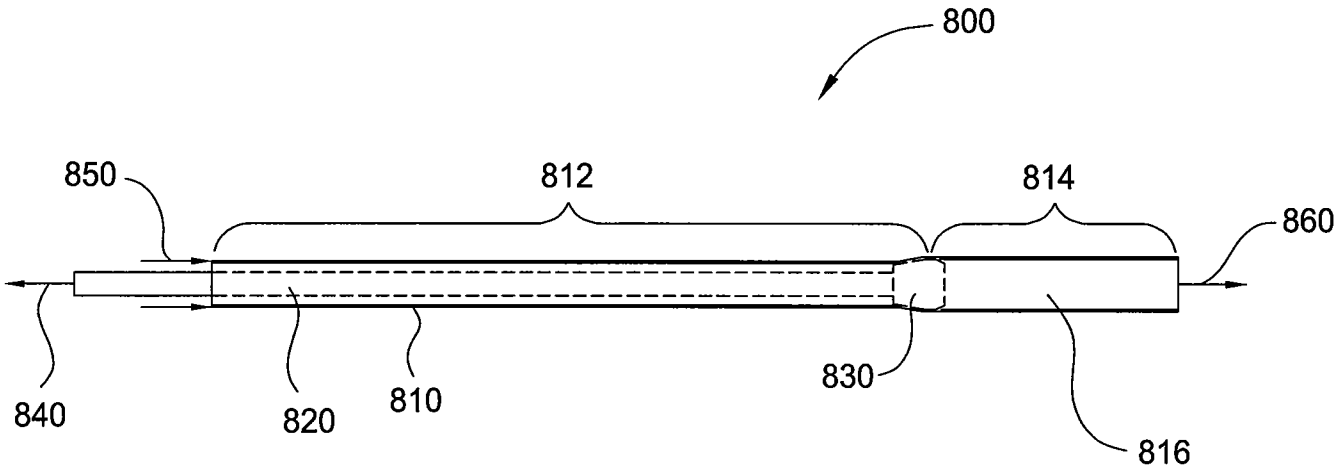
FIG. 8 illustrates an embodiment of a test configuration for expanding a tubular connection.

FIGS. 1, 2, 3, and 8 illustrate embodiments of a testing configuration for expanding a tubular connection under a "fixed-free" expansion. A fixed-free expansion is when a tubular string is fixed at a first end but free at a second end, thereby permitting the tubular material to accommodate a change in axial length, such as shorten or shrink, as its diameter is enlarged. FIG. 1 illustrates a first test configuration 100, FIG. 2 illustrates a second test configuration 200, FIG. 3 illustrates a third test configuration 300, and FIG. 8 illustrates a fourth test configuration 800.

FIG. 1 illustrates the first test configuration 100 for simulating the downhole expansion of a tubular connection. The first test configuration 100 includes an expandable tubular 110, a work string 120 extending through the tubular 110, and an expander 130 disposed within a lower end of the tubular and connected to the end of the work string 120. The tubular 110 may include one or more tubular members connected together by one or more connections. The tubular 110 is fixed at a first end by a fixed constraint 140. A first load 150 may be applied to the work string 120. In one embodiment, the first load 150 may be applied to the work string 120 by one or more ways known by one of ordinary skill in the art. In one embodiment, the first load 150 may be applied to the work string 120 using one or more piston cylinders. The first load 150 is transferred to the tubular 110 via the expander 130, to thereby compress a length 112 of the tubular ahead of the expander 130 against the fixed constraint 140. Placing the length 112 of the tubular in compression simulates a compressive load generated by tubular string weight that places a tubular string connection in compression when supported downhole. The amount of compression applied to the length 112 may simulate the amount of compression experienced by a tubular string connection, depending on its location along a length of a tubular string when downhole. The amount of compression applied to the length 112 of the tubular 110 may therefore be greater than, less than, or equal to the amount of compression that may be generated by the actual weight of the length 112 of the tubular 110 located ahead of the expander 130. A second load 160, opposite the first load 150, may then be applied to a second end of the tubular 110. In one embodiment, the second load 160 may be applied to the work string 120 by one or more ways known by one of ordinary skill in the art. In one embodiment, the second load 160 may be applied to the work string 120 using one or more piston cylinders. The second load 160 places a length 114 of the tubular behind the expander 130 in tension. Placing the length 114 of the tubular in tension simulates a tensile load generated by tubular string weight that places a tubular string connection in tension when supported downhole. The amount of tension applied to the length 114 may simulate the amount of tension experienced by a tubular string connection, depending on its location along a length of a tubular string when downhole. The amount of tension applied to the length 114 of the tubular 110 may therefore be greater than, less than, or equal to the amount of tension that may be generated by the actual weight of the length 114 of the tubular 110 located behind the expander 130. In one embodiment, the application of the first and second loads 150 and 160 may be insufficient to move the expander 130 through the tubular 110. In one embodiment, the first and second loads 150 and 160 may be pre-determined and may remain constant during expansion of the tubular 110.

Prior to expansion, the first test configuration 100 may apply calculated first and second loads 150 and 160 to the tubular 110 to simulate the run-in and un-expanded position of a tubular connection when located in a vertical, horizontal, and/or lateral wellbore. After the applicable loads are applied to the tubular 110, fluid pressure may then be supplied through the work string 120 into a sealed chamber 116, formed between the expander 130 and the lower end of the tubular 110, to move the expander 130 through the tubular 110. In one embodiment, the fluid pressure may be supplied to the sealed chamber 116 directly through a port in the tubular 110. Supplying fluid pressure into the chamber 116 may further place the length 114 of the tubular behind the expander 130 in tension to simulate the tensile load that would be generated by the thrust force of the fluid pressure. In one embodiment, the loads may be applied to the tubular 110 upon and/or as a result of expansion of the tubular.

The combination of tension, compression, and fluid pressure are calculated to exceed the requisite expansion force necessary to expand the tubular 110. During expansion, the first and second loads 150 and 160 and the fluid pressure are continuously maintained according to a predetermined schedule as the expander 130 moves through and expands the tubular 110 to simulate the tension and compression loads in the tubular when downhole. In one embodiment, the predetermined schedule may include varying one or more of the tension and/or compression loads during expansion of the tubular. In one embodiment, the predetermined schedule may include maintaining one or more of the tension and/or compression loads constant during expansion of the tubular. In one embodiment, as the expander 130 moves through the tubular 110, the compressive load applied to the length 112 of the tubular remains constant and the tensile load applied to the length 114 of the tubular remains constant. To ensure a constant load, the mechanism used to provide the first load 150 is continuously adjusted to account for the application of the second load 160 and the fluid pressure, and vice versa. The mechanisms used to provide the first load 150, second load 160, and the fluid pressure are also adjusted to account for changes in the lengths 112 and 114 of the tubular 110 located ahead of and behind the expander 130 as it moves from one end to the other end. Adjustments may also be made to account for the shrinkage of the tubular 110 during expansion. In one embodiment, one or more controllers may be used to automatically adjust the mechanisms used to provide the first and second loads 150 and 160 and the fluid pressure during expansion.

FIG. 2 illustrates the second test configuration 200 for simulating the downhole expansion of a tubular connection. The second test configuration 200 includes an expandable tubular 210, a work string 220 extending through the tubular 210, and an expander 230 disposed within a lower end of the tubular and connected to the end of the work string 220. The tubular 210 may include one or more tubular members connected together by one or more connections. The work string 220 is fixed at an end by a fixed constraint 240. A first load 250 may be applied to a first end of the tubular 210. In one embodiment, the first load 250 may be applied to the tubular 210 by one or more ways known by one of ordinary skill in the art. In one embodiment, the first load 250 may be applied to the tubular 210 using one or more piston cylinders. The first load 250 is applied to the tubular 210 to thereby compress a length 212 of the tubular against the expander 230, which is secured to the fixed constraint 240 via the work string 220. Placing the length 212 of the tubular in compression simulates a compressive load generated by tubular string weight that places a tubular string connection in compression when supported downhole. The amount of compression applied to the length 212 may simulate the amount of compression experienced by a tubular string connection, depending on its location along a length of a tubular string when downhole. The amount of compression applied to the length 212 of the tubular 210 may therefore be greater than, less than, or equal to the amount of compression that may be generated by the actual weight of the length 212 of the tubular 210 located ahead of the expander 230. A second load 260 may then be applied to the lower end of the tubular 210 in a similar manner as the second load 160 described above. The second load 260 places a length 214 of the tubular behind the expander 230 in tension, as the expander 230 is secured to the fixed constraint 240 via the work string 220. Placing the length 214 of the tubular in tension simulates a tensile load generated by tubular string weight that places a tubular string connection in tension when supported downhole. The amount of tension applied to the length 214 may simulate the amount of tension experienced by a tubular string connection, depending on its location along a length of a tubular string when downhole. The amount of tension applied to the length 214 of the tubular 210 may therefore be greater than, less than, or equal to the amount of tension that may be generated by the actual weight of the length 214 of the tubular 210 located behind the expander 230. In one embodiment, the application of the first and second loads 250 and 260 may be insufficient to move the expander 230 through the tubular 210 (or move the tubular 210 over the expander 230). In one embodiment, the first and second loads 250 and 260 may be pre-determined and may remain constant during expansion of the tubular 210.

Prior to expansion, the second test configuration 200 may apply calculated first and second loads 250 and 260 to the tubular 210 to simulate the run-in and un-expanded position of a tubular connection when located in a vertical, horizontal, and/or lateral wellbore. After the applicable loads are applied to the tubular 210, fluid pressure may then be supplied through the work string 210 into a sealed chamber 216, formed between the expander 230 and the lower end of the tubular 210, to move the expander 230 through the tubular 210 (or move the tubular 210 over the expander 230). In one embodiment, the fluid pressure may be supplied to the sealed chamber 216 directly through a port in the tubular 210. Supplying fluid pressure into the chamber 216 may further place the length 214 of the tubular behind the expander 230 in tension to simulate the tensile load that would be generated by the thrust force of the fluid pressure. In one embodiment, the loads may be applied to the tubular 210 upon and/or as a result of expansion of the tubular.

The combination of tension, compression, and fluid pressure are calculated to exceed the requisite expansion force necessary to expand the tubular 210. During expansion, the first and second loads 250 and 260 and the fluid pressure are continuously maintained according to a predetermined schedule as the expander 230 moves through and expands the tubular 210 (or the tubular 210 moves over the expander 230 and is expanded) to simulate the tension and compression loads in the tubular when downhole. In one embodiment, the predetermined schedule may include varying one or more of the tension and/or compression loads during expansion of the tubular. In one embodiment, the predetermined schedule may include maintaining one or more of the tension and/or compression loads constant during expansion of the tubular. In one embodiment, as the expander 230 moves through the tubular 210 (or the tubular 210 moves over the expander 230), the compressive load applied to the length 212 of the tubular remains constant and the tensile load applied to the length 214 of the tubular remains constant. To ensure a constant load, the mechanism used to provide the first load 250 is continuously adjusted to account for the application of the second load 260 and the fluid pressure, and vice versa. The mechanisms used to provide the first load 250, the second load 260, and the fluid pressure are adjusted to account for the changes in the length 212 and 214 of the tubular 210 located ahead of and behind the expander 230 as it moves from one end to the other end. Adjustments may also be made to account for the shrinkage of the tubular 210 during expansion. In one embodiment, one or more controllers may be used to automatically adjust the mechanisms used to provide the first and second loads 250 and 260 and the fluid pressure during expansion.

FIG. 3 illustrates the third test configuration 300 for simulating the downhole expansion of a tubular connection. The third test configuration 300 includes an expandable tubular 310, a work string 320 extending through the tubular 310, and an expander 330 disposed within a lower end of the tubular and connected to the end of the work string 320. The tubular 310 may include one or more tubular members connected together by one or more connections. The tubular 310 is fixed at an end by a fixed constraint 340. A first load 350 may be applied to a first end of the tubular 310 in a similar manner as the first load 250 described above. The first load 350 is applied to the tubular 310 to thereby compress a length 312 of the tubular against the expander 330 (which is secured to the work string 320) and the fixed constraint 340. Placing the length 312 of the tubular in compression simulates a compressive load generated by tubular string weight that places a tubular string connection in compression when supported downhole. The amount of compression applied to the length 312 may simulate the amount of compression experienced by a tubular string connection, depending on its location along a length of a tubular string when downhole. The amount of compression applied to the length 312 of the tubular 310 may therefore be greater than, less than, or equal to the amount of compression that may be generated by the actual weight of the length 312 of the tubular 310 located ahead of the expander 330. A second load 360, opposite the first load 350, may then be applied to the work string 320 in a similar manner as the first load 150 described above. The second load 360 is transferred to the tubular 310 via the expander 330, to thereby compress the length 312 of the tubular ahead of the expander 330 against the first load 350 as recited above. The second load 360 also places a length 314 of the tubular behind the expander 330 in tension, as the end of the tubular 310 is secured to the fixed constraint 340. Placing the length 314 of the tubular in tension simulates a tensile load generated by tubular string weight that places a tubular string connection in tension when supported downhole. The amount of tension applied to the length 314 may simulate the amount of tension experienced by a tubular string connection, depending on its location along a length of a tubular string when downhole. The amount of tension applied to the length 314 of the tubular 310 may therefore be greater than, less than, or equal to the amount of tension that may be generated by the actual weight of the length 314 of the tubular 310 located behind the expander 330. In one embodiment, the application of the first and second loads 350 and 360 may be insufficient to move the expander 330 through the tubular 310. In one embodiment, the first and second loads 350 and 360 may be pre-determined and may remain constant during expansion of the tubular 310.

Prior to expansion, the third test configuration 300 may apply calculated first and second loads 350 and 360 to the tubular 310 to simulate the run-in and un-expanded position of a tubular connection when located in a vertical, horizontal, and/or lateral wellbore. After the applicable loads are applied to the tubular 310, fluid pressure may then be supplied through the work string 320 into a sealed chamber 316, formed between the expander 330 and the lower end of the tubular 310, to move the expander 330 through the tubular 310. In one embodiment, the fluid pressure may be supplied to the sealed chamber 316 directly through a port in the tubular 310. Supplying fluid pressure into the chamber 316 may further place the length 314 of the tubular behind the expander 330 in tension to simulate the tensile load that would be generated by the thrust force of the fluid pressure. In one embodiment, the loads may be applied to the tubular 310 upon and/or as a result of expansion of the tubular.

The combination of tension, compression, and fluid pressure are calculated to exceed the requisite expansion force necessary to expand the tubular 310. During expansion, the first and second loads 350 and 360 and the fluid pressure are continuously maintained according to a predetermined schedule as the expander 330 moves through and expands the tubular 310 to simulate the tension and compression loads in the tubular when downhole. In one embodiment, the predetermined schedule may include varying one or more of the tension and/or compression loads during expansion of the tubular. In one embodiment, the predetermined schedule may include maintaining one or more of the tension and/or compression loads constant during expansion of the tubular. In one embodiment, as the expander 330 moves through the tubular 310, the compressive load applied to the length 312 of the tubular remains constant and the tensile load applied to the length 314 of the tubular remains constant. To ensure a constant load, the mechanism used to provide the first load 350 is continuously adjusted to account for the application of the second load 360 and the fluid pressure, and vice versa. The mechanisms used to provide the first load 350, the second load 360, and the fluid pressure are also continuously adjusted to account for the changes in the lengths 312 and 314 of the tubular 310 located ahead of and behind the expander 330 as it moves from one end to the other end. Adjustments may also be made to account for the shrinkage of the tubular 310 during expansion. In one embodiment, one or more controllers may be used to automatically adjust the mechanisms used to provide the first and second loads 350 and 360 and the fluid pressure during expansion.

In one embodiment, the first, second, third, and fourth test configurations 100, 200, 300, and 800 may also be operable to accurately simulate a "fixed-fixed" expansion. The expandable tubular string can be secured or locked at both ends to prevent the tubular string from shrinking during expansion, which will produce an additional tension load in the tubular string. The tension and compression loads can thus be adjusted as necessary to simulate the loads in a tubular when expanded downhole in a fixed-fixed expansion, such as the expansion of a tubular which has become stuck within a wellbore, or the expansion of a tubular in a horizontal wellbore.

Using the first, second, third, and fourth test configurations, the tension and compression loads can be applied before the expander moves and can then be maintained once the expander starts moving. In one embodiment, the expandable tubular string can be expanded using only a mechanical expansion of the tubular without the addition of fluid pressure. In one embodiment, the expandable tubular string can be loaded by the first load, the second load, and the fluid pressure in any order. In one embodiment, the predetermined schedule of loads applied to the expandable tubular may include provision for changing one or more of the applied loads during and/or after a section of the expandable tubular has been expanded. In one embodiment, the tension and compression loads applied to the expandable tubular may be permitted to change as a result of the expansion process while the expansion is being executed. The first, second, and third test configurations can thus be used to simulate the expansion of test samples from any position in an expandable tubular string.

Figure 4:
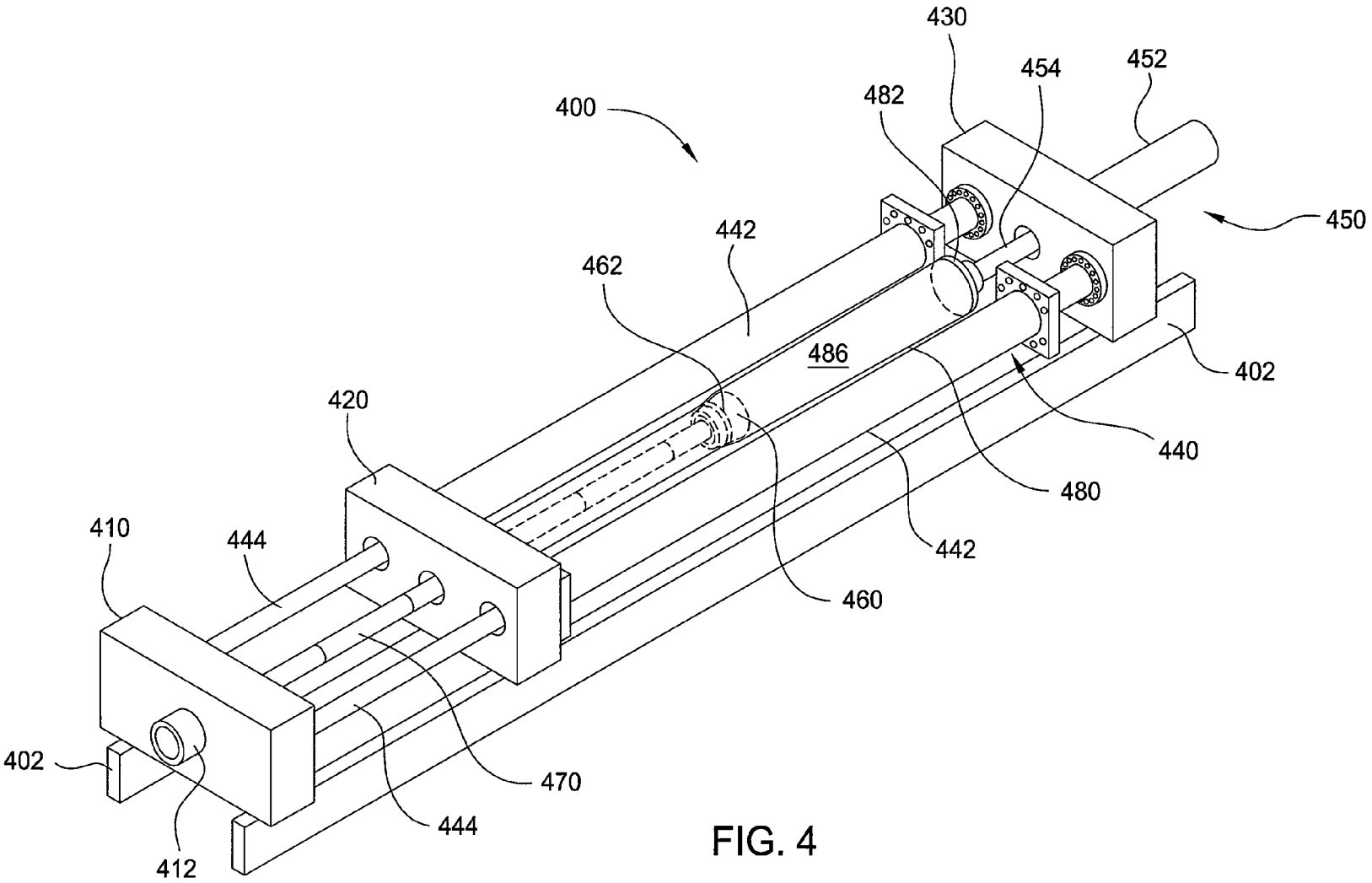
FIG. 4 illustrates an embodiment of a test assembly for expanding a tubular connection.

FIG. 4 illustrates a test assembly 400 for expanding a tubular string having one or more connections, according to the first test configuration 100 described above. The test assembly 400 is operable to apply and optionally maintain tension and compression loads on a first length of a tubular string located in front of an expander and a second length of the tubular string located behind the expander, while the expander moves through and expands the tubular. The test assembly 400 is thus operable to accurately simulate the expansion of tubular string connections under downhole conditions.

The test assembly 400 includes a frame 402, such as a pair or rails, for supporting a first crosshead 410, a second crosshead 420, and a third crosshead 430. The term "frame" as defined herein may be any support structure or surface, including the ground, which is operable to support one or more components of the test assemblies described herein. The term "crosshead" as defined herein may similarly include any type of support structure or surface that is operable to support one or more components of the test assemblies described herein. The first crosshead 410 is movable relative to the frame 402, and the second and third crossheads 420 and 430 are stationary and fixed to the frame 402. The test assembly 400 also includes one or more first actuation assemblies 440 configured to apply a first load to a test sample 480, and one or more second actuation assemblies 450 configured to apply a second load to the test sample 480. The test assembly 400 further includes an expander 460, such as a cone, that is connected to the first crosshead 410 via a work string 470. The work string 470 may be a tubular member or connecting rod having a flow bore therethrough. The work string 470 may be connected to the first crosshead 410, such as by a welded or threaded connection, and may extend through an opening in the second crosshead 420 and into the test sample 480. Fluid communication to the test sample 480 may be established through an opening 412 of the first crosshead 410 which is in fluid communication with the flow bore of the work string 470. The expander 460 may be connected to the lower end of the work string 470 and positioned within the test sample 480. The expander 460 may be provided with one or more seals 462, such as seal cups, to form a sealed chamber 486 within the test sample 480. The test sample 480 may include an expandable tubular string having one or more expandable tubular members that are connected together by one or more threaded connections. A first end of the test sample 480 may be supported by the second crosshead 420, and a second end of the test sample 480 may be closed and/or sealingly connected to the second actuation assembly 450, such as by a welded or threaded connection.

In one embodiment, the first actuation assembly 440 may include a pair of piston cylinders 442 and piston rods 444 that are operable to move the first cross head 410. The piston cylinders 442 may be connected to the second and third crossheads 420 and 430 using one or more flanged connections, and the piston rods 444 may be connected to the first crosshead 410 in a manner that the rods 444 extend through openings in the second crosshead 420. The piston cylinders 442 and rods 444 may have a stroke within a range of about 5 feet to about 25 feet. In one embodiment, the stroke may be about 15 feet. The first actuation assembly 440 is configured to apply a compressive force to the test sample 480. Placing the test sample 480 in compression simulates a compressive load generated by tubular string weight that places a tubular string connection in compression when supported downhole. The amount of compression applied to the test sample 480 may simulate the amount of compression experienced by the tubular string connection, depending on its location along a length of the tubular string when downhole. The compression load is generated by pulling on the expander 460, via the work string 470 and the first crosshead 410, by actuation of the piston cylinders 442 and rods 444. The portion of the test sample 480 ahead of the expander 460 may thus be compressed between the expander 460 and the second crosshead 420. The compression load is maintained by adjusting the pressure supplied to the first actuation assembly 440 as the expander 460 moves through the test sample 480 and as the test sample 480 shrinks in length.

In one embodiment, the second actuation assembly 450 may include a piston cylinder 452 and a piston rod 454 that are operable to apply a force to the test sample 480. The piston cylinder 452 may be connected to the third crosshead 430 using a flanged connection, and the piston rod 454 may be connected to the test sample 480 in a manner that the rod 454 extends through an opening in the third crosshead 430. The rod 454 may be connected to the test sample 480 using an end cap 482 that is secured to the end of the rod 454. The piston cylinder 452 and rod 454 may have a stroke within a range of about 5 feet to about 25 feet. In one embodiment, the stroke may be about 15 feet. The second actuation assembly 450 is configured to apply a tensile force to the test sample 480. Placing the test sample 480 in tension simulates a tensile load generated by tubular string weight that places a tubular string connection in tension when supported downhole. The amount of tension applied to the test sample 480 may simulate the amount of tension experienced by the tubular string connection, depending on its location along a length of the tubular string when downhole. The tension load is generated by pulling on the test sample 480 by actuation of the piston cylinder 452 and rod 454. The portion of the test sample 480 behind the expander 460 is thus tensioned by the opposing forces provided by the second actuation assembly 450 and the expander 460 via the first actuation assembly 440. The tension load is maintained by adjusting the pressure supplied to the second actuation assembly 450 as the expander 460 moves through the test sample 480 and as the test sample 480 shrinks in length.

The application of the compression and tension loads by the first and second actuation assemblies 440 and 450 may be insufficient to move the expander 460 through the test sample 480. The test assembly 400 may apply calculated compression and tension loads to the test sample to simulate the run-in and un-expanded position of a tubular connection when located in a vertical, horizontal, and/or lateral wellbore. After the pre-loads are applied to the test sample 480, fluid pressure may be continuously supplied through the work string 470 into the sealed chamber 486 until the expansion force is reached to move the expander 460 through the test sample 480. In one embodiment, the fluid pressure may be supplied to the sealed chamber 486 directly through a port in the test sample 480. Supplying fluid pressure into the chamber 486 may further place the length of the test sample 480 behind the expander 460 in tension to simulate the tensile load that would be generated by the thrust force of the fluid pressure. In one embodiment, a hydraulic fluid such as water may be supplied into the chamber 486 by a pump to generate the thrust force necessary to move the expander 460.

The combination of tension, compression, and fluid pressure are calculated to exceed the requisite expansion force necessary to expand the tubular test sample. During expansion, the tension and compression loads provided by the first and second actuation assemblies 440 and 450 are continuously maintained according to a predetermined schedule as the expander 460 moves through and expands the test sample 480 to simulate the loads on a tubular connection when downhole. In one embodiment, the predetermined schedule may include varying one or more of the tension and/or compression loads during expansion of the test sample 480. In one embodiment, the predetermined schedule may include maintaining one or more of the tension and/or compression loads constant during expansion of the test sample 480. In one embodiment, as the expander 460 moves through the test sample 480, the compressive load applied to the length of the test sample 480 ahead of the expander 460 remains the same and the tensile load applied to the length of the test sample 480 behind the expander 460 remains the same. To ensure a constant load, the fluid pressure and the pressures supplied to the piston cylinders 442 and 452 and rods 444 and 454 are continuously adjusted to account for the application of different loads and the changes in the lengths of the test sample 480 ahead of and behind the expander 460, as the expander 460 moves from one end to the other end. In one embodiment, the piston rod 454 of the second actuation assembly 450 may extend during expansion of the test sample 480 to accommodate for the shrinkage of the test sample 480, while maintaining the requisite tensile load on the test sample 480. In one embodiment, the test assembly 400 may be operable to accommodate for up to about a 10 percent shortening of the length of the test sample 480 during expansion. In one embodiment, one or more controllers may be used to automatically adjust the actuation pressure of the piston cylinders 442 and 452 and the fluid pressure during expansion. In one embodiment, the predetermined schedule of loads applied to the expandable tubular may include provision for changing one or more of the applied loads during and/or after a section of the expandable tubular has been expanded. In one embodiment, the tension and compression loads applied to the expandable tubular may be permitted to change as a result of the expansion process while the expansion is being executed.

In one embodiment, all of the components of the test assembly 400 are controlled by a controller, such as a computer that continually monitors the loads that are to be maintained. As the expander 460, the piston rods 444 and 454, and the first crosshead 410 move, the controller maintains the pressures inside the piston cylinders 442 and 452 by pumping or removing hydraulic fluid. In one embodiment, the controller may include one or more pump controls that are configured to regulate the flow and pressure of hydraulic fluids to the piston cylinders 442 and 452. In one embodiment, the controller may include one or more sensors, such as load cells, that are configured to communicate to the controller what the loads are in the test sample 480 during expansion. In one embodiment, the controller may be configured to continuously monitor and maintain the supply of fluid pressure to the test sample 480 to provide the thrust force necessary to move the expander 460.

The test assembly 400 is operable to accurately simulate numerous variations of a "fixed-free" or a "fixed-fixed" expansion. In one embodiment, the test sample 480 can be expanded using one or more combinations of the first and second actuation assemblies and fluid pressure. In one embodiment, the test sample 480 can be constrained at both ends to prevent the test sample 480 from length shrinkage during expansion.

In one embodiment, the piston cylinders 442 and 452 may be operable to supply a force within a range of about a 100,000 pound-force to about a 200,000 pound-force to the test sample. In one embodiment, the piston cylinders 442 and 452 may be operable to supply a force within a range of about a 200,000 pound-force to about a 325,000 pound-force to the test sample. In one embodiment, the piston cylinders 442 and 452 may be operable to supply a force within a range of about a 325,000 pound-force to about a 500,000 pound-force to the test sample. In one embodiment, the piston cylinders 442 and 452 may be operable to supply a force within a range of about a 500,000 pound-force to about a 650,000 pound-force to the test sample.

In one embodiment, the test assembly 400 may be configured so that the distance between the longitudinal axis of the piston cylinders and rods 442 and 444 may be within a range of about 47 inches to about 62 inches. In one embodiment, the test assembly 400 may be configured so that the distance between the outer diameters of the piston cylinders 442 may be within a range of about 33 inches to about 48 inches. In one embodiment, the test assembly 400 may be configured so that the distance between the outer diameter of the test sample after expansion and the outer diameter of the piston cylinders 442 may be within a range of about 8 inches to about 16 inches.

In one embodiment, the test assembly 400 may be operable to expand test samples within a range of about 3½ inches in diameter to about 13⅜ inches or about 16 inches in diameter. In one embodiment, the test assembly 400 may include a pump system operable to supply up to about 10,000 PSI into the test sample. In one embodiment, the test assembly 400 is operable to move the expander 460 through the test sample 480 at a speed up to about 10 feet per minute.

Figure 4A:
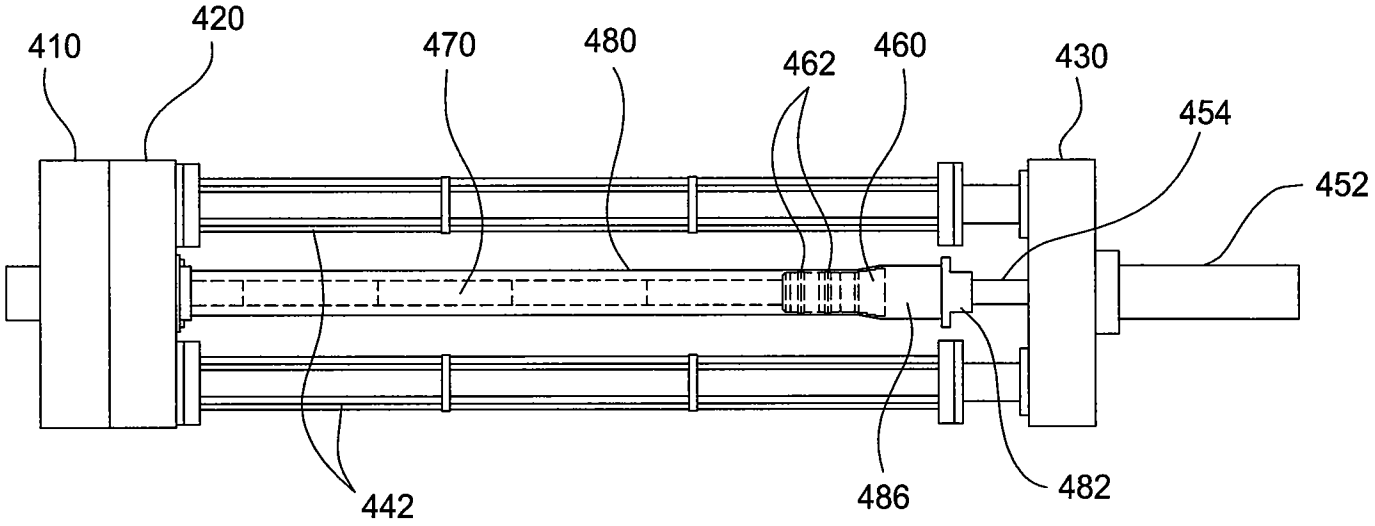
FIGS. 4A, 4B, 4C, and 4D illustrate a sequence of operational steps using the test assembly for expanding a tubular connection.

FIGS. 4A-4D illustrate an operational sequence of the test assembly 400 according to one embodiment. FIG. 4A illustrates the start position of the test assembly 400. As shown, the expander 460 is located an end of the test sample 480. The first and second actuation assemblies 440 and 450 are actuated to apply the preloads to the test sample 480. The piston cylinders and rods 442 and 444 push on the movable first crosshead 410, which pulls on the expander 460 via the work string 470, to apply a compression load to the test sample 480 between the expander 460 and the second crosshead 420. The amount of compression depends on the downhole conditions being simulated. The amount of compression provided by the test assembly 400 may accurately simulate string weight compression in one or more threaded connections positioned at various locations along a length of a tubular string when downhole. The piston cylinder and rod 452 and 454 pulls on the test sample 480 to apply a tension load to the test sample 480 behind the expander 460. Similarly, the amount of tension depends on the downhole conditions being simulated. The amount of tension provided by the test assembly 400 may accurately simulate string weight tension in one or more threaded connections positioned at various locations along a length of a tubular string when downhole. Fluid pressure is then continuously supplied to the chamber 486 via the work string 470 (and/or directly into the chamber 486 via a port in the test sample 480) until the expander 460 begins to move. The fluid pressure in the chamber 486 generates an additional tension load to the test sample 480 behind the expander from the end thrust. The compression, tension, and fluid pressure combine to generate the expansion force required to move the expander 460 and expand the test sample 480.

Figure 4B:
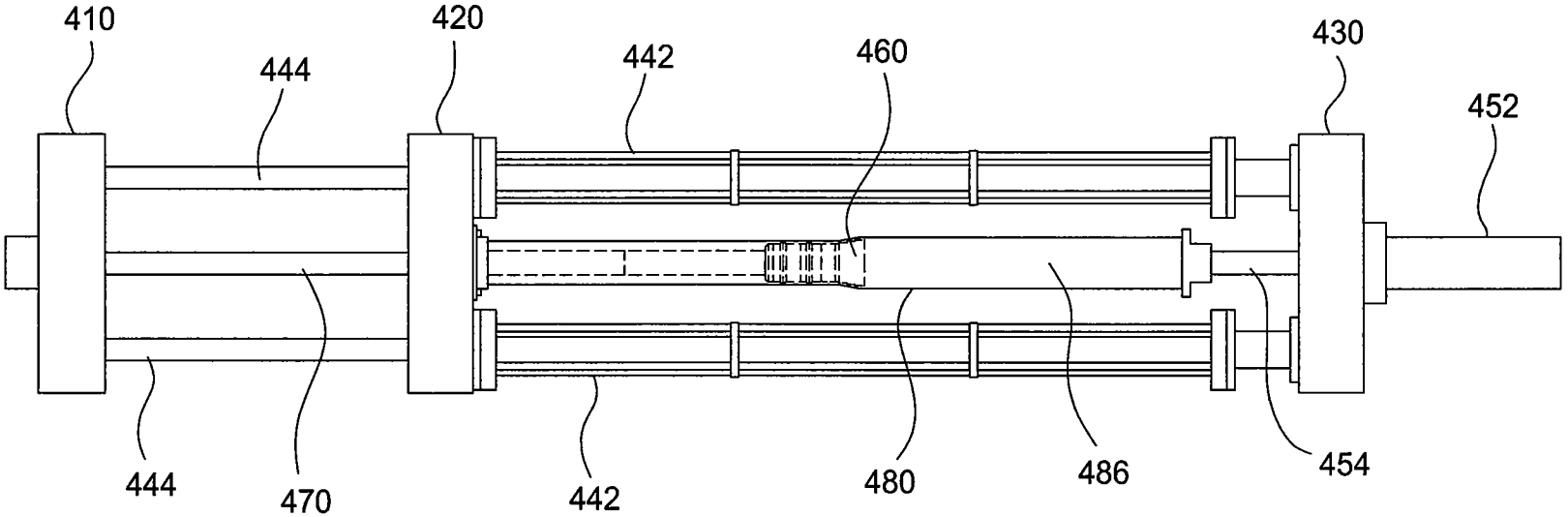

FIG. 4B illustrates the expansion of the test sample 480 at mid-stroke of the first actuation assemblies 440. As shown, the first crosshead 410 has been pushed to about half of its maximum travel distance by the piston cylinders and rods 442 and 444. The expander 460 has expanded about half of the test sample 480. The applied compression and tension loads are being maintained even though all of the piston cylinders and rods are in motion. The loads may be maintained with the use of one or more controllers that are in communication with the piston cylinders. The test sample 480 may shrink in length up to about 10 percent, and the length change of the test sample 480 is compensated by the second actuation assembly 450. As show, the piston rod 454 has extended to accommodate for the shrinkage of the test sample 480, while maintaining the tension load. The piston cylinders and rods 442 and 444 will also dampen or resist any expander "jump" or quick acceleration.

Figure 4C:
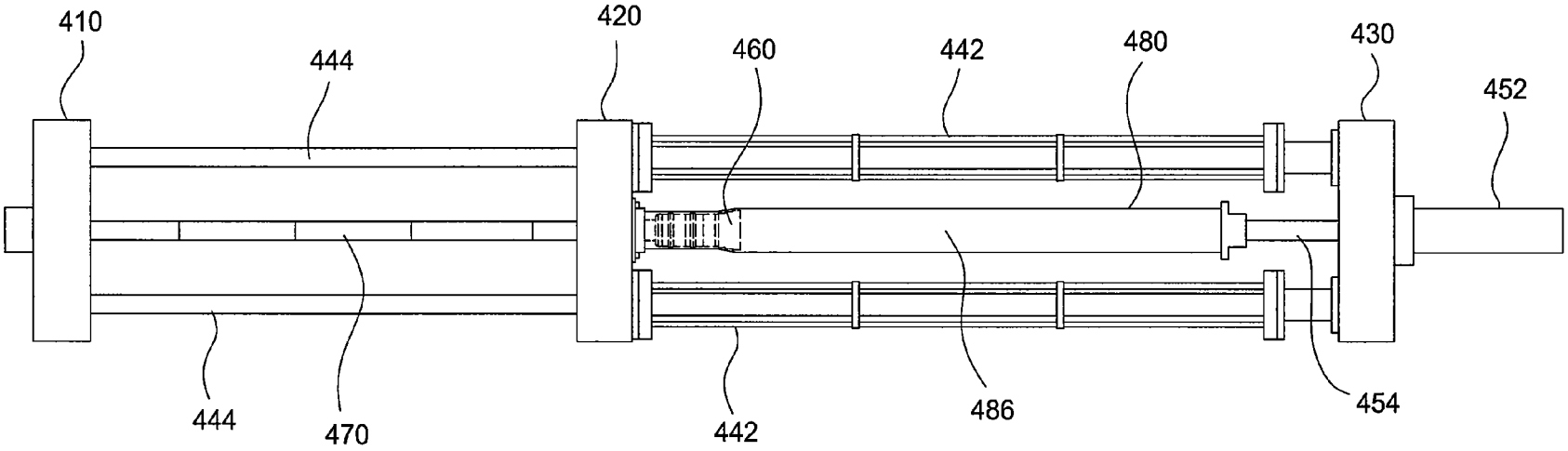
Figure 4D:
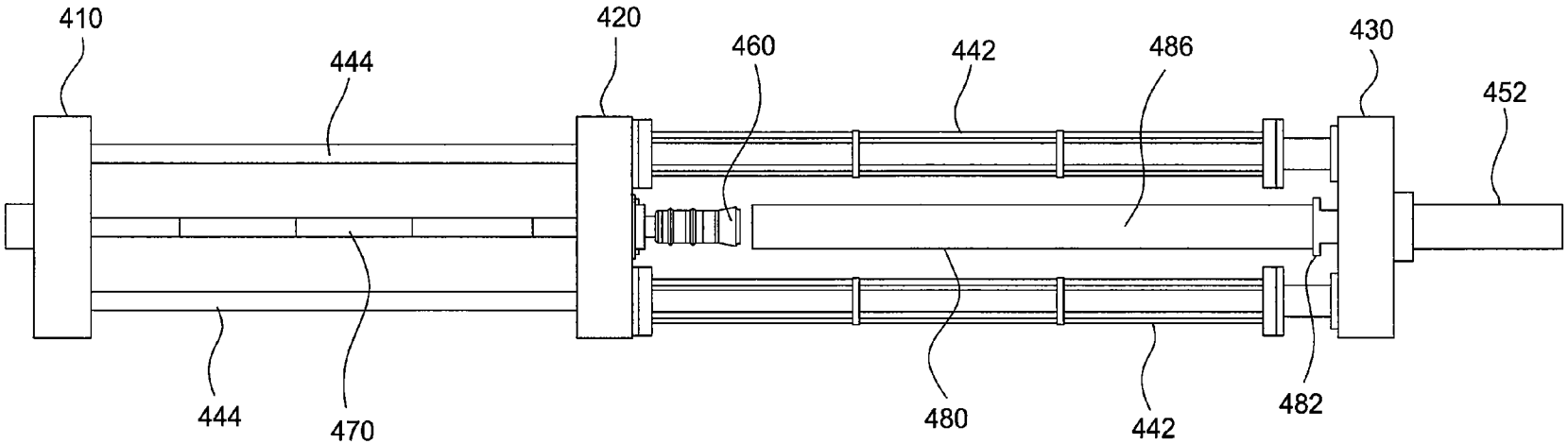

FIG. 4C illustrates the expansion of the test sample 480 at or near full-stroke of the first actuation assemblies 440. As shown, the expander 460 has reached the end of the test sample 480 and the fluid pressure is released, which stops the expansion motion. At this point, all applied loads by the piston cylinders are also released. FIG. 4D illustrates the removal of the expander 460 from the test sample 480. In one embodiment, piston cylinders and rods 442 and 444 of the first actuation assemblies 440 are locked in place, and the second actuation assembly 450 is actuated to retract the piston rod 454 to pull the test sample 480 off of the expander 460. In one embodiment, piston cylinder and rod 452 and 454 of the second actuation assembly 450 are locked in place, and the first actuation assembly 440 is actuated to extend the piston rods 444 to pull the expander 460 from the test sample 480. In one embodiment, a combination of the first and second actuation assemblies 440 and 450 are used to remove the expander 460 and the test sample 480. The test sample 480 can be removed from the test assembly 400 and used to conduct further analysis of the expanded connections.

In one embodiment, the test assembly 400 is operable to expand the test sample 480 under a "fixed-fixed" expansion, to simulate when an expandable tubular is stuck in a wellbore or when the ends of the tubular are constrained. In a fixed-fixed expansion, the tubular will experience an additional tension load since it is prevented from shrinking. The test assembly 400 may simulate this additional tension load by locking the second actuation assembly 450 in place before and/or after the loads are applied to the test sample 480, and not permitting the piston rod 454 to extend to compensate for the shortening of the test sample 480. In one embodiment, the upper end of the test sample 480 may be secured to the second crosshead 420 during expansion to prevent shortening. In one embodiment, the test sample 480 may be expanded immediately upon actuation of the first actuation assembly 440, the second actuation assembly 450, and/or the fluid pressure. The pre-determined tension and/or compression loads are may be applied to the test sample 480 upon and/or as a result of expansion of the test sample 480.

In one embodiment, the test assembly 400 can be used to produce expanded tubular connection samples simulated from any location in a tubular string, whether the string is vertical and unconstrained or horizontal and constrained at both ends. The test assembly 400 can also be used to expand test samples using only a mechanical force without the addition of fluid pressure, which would simulate cone expansions using a downhole jack or a rig apparatus applying the requisite expansion force. In one embodiment, the different tension and compression forces can be applied to the test sample 480 in any order. In one embodiment, the first and second loads from the test assembly 400 may be pre-determined and may remain constant during expansion of the test sample 480.

Figure 5:
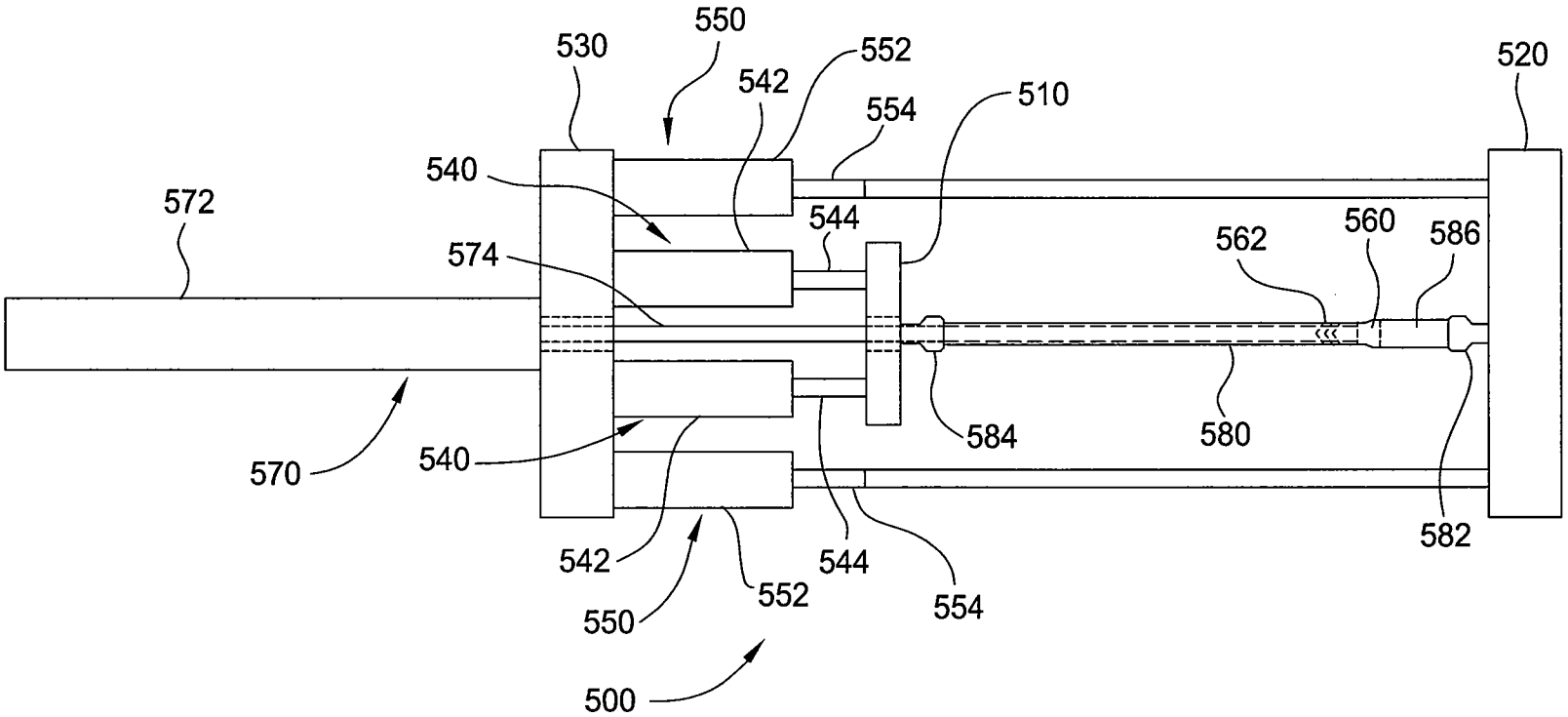
FIG. 5 illustrates an embodiment of a test assembly for expanding a tubular connection.

FIG. 5 illustrates a test assembly 500 for expanding a tubular string having one or more connections, according to one or more of the test configurations 100, 200, 300, and 800 described herein. The embodiments, described above with respect to the test assembly 400 may also be provided using the test assembly 500. The test assembly 500 is operable to apply and maintain tension and compression loads on a first length of a tubular string located in front of an expander and a second length of the tubular string located behind the expander, while the expander moves through and expands the tubular. The test assembly 500 is thus operable to accurately simulate the expansion of tubular string connections under downhole conditions.

The test assembly 500 may include a frame, such as a pair or rails, for supporting a first crosshead 510, a second crosshead 520, and a third crosshead 530. The first and second crossheads 510 and 520 may be movable relative to the frame, and the third crosshead 530 may be stationary and fixed to the frame. The test assembly 500 also includes one or more first actuation assemblies 540 configured to apply a first load to a test sample 580, one or more second actuation assemblies 550 configured to apply a second load to the test sample 580, and one or more third actuation assemblies 570 configured to apply a third load to the test sample 580. The test assembly 500 further includes an expander 560, such as a cone, that is connected to the third actuation assembly 570 via a piston rod 574. The piston rod 574 may be a tubular member or connecting rod having a flow bore therethrough. The piston rod 574 may extend through an opening in the third crosshead 530 and into the test sample 580. Fluid communication to the test sample 580 may be established through the flow bore of the piston rod 574. The expander 560 may be connected to the lower end of the piston rod 574 and positioned within the test sample 580. The expander 560 may be provided with one or more seals 562, such as seal cups, to form a sealed chamber 586 within the test sample 580. The test sample 580 may include an expandable tubular string having one or more expandable tubular members that are connected together by one or more threaded connections. The upper end of the test sample 580 may be connected to an end cap 584 that is supported by the first crosshead 510, and the lower end of the test sample 580 may be closed and/or sealingly connected to an end cap 582 that is supported by the second crosshead 520.

In one embodiment, the first actuation assembly 540 may include a pair of piston cylinders 542 and piston rods 544 that are operable to move the first crosshead 510. The piston cylinders 542 may be connected to the third crosshead 530 using one or more flanged connections, and the piston rods 544 may be connected to the first crosshead 510 in a similar manner. The piston cylinders 542 and rods 544 may be the same piston cylinders and rods 442 and 444 described above. The first actuation assembly 540 is configured to apply a compressive force to the test sample 580. Placing the test sample 580 in compression simulates a compressive load generated by tubular string weight that places a tubular string connection in compression when supported downhole. The amount of compression applied to the test sample 580 may simulate the amount of compression experienced by the tubular string connection, depending on its location along a length of the tubular string when downhole. The compression load is generated by pushing the first crosshead 510 by actuation of the piston cylinders 542 and rods 544. The portion of the test sample 580 ahead of the expander 560 may thus be compressed between the end cap 584 of the first crosshead 510 and the expander 560, which is secured by the third crosshead 530 and the third actuation assembly 570. The compression load is maintained by adjusting the pressure supplied to the first actuation assembly 540 as the expander 560 moves through the test sample 580 and as the test sample 580 shrinks in length.

In one embodiment, the second actuation assembly 550 may include a pair of piston cylinders 552 and piston rods 554 that are operable to move the second crosshead 520. The piston cylinders 552 may be connected to the third crosshead 530 using one or more flanged connections, and the piston rods 554 may be connected to the second crosshead 520 in a similar manner. The piston cylinders 552 and rods 554 may be the same piston cylinders and rods 452 and 454 described above. The second actuation assembly 550 is configured to apply a tensile force to the test sample 580. Placing the test sample 580 in tension simulates a tensile load generated by tubular string weight that places a tubular string connection in tension when supported downhole. The amount of tension applied to the test sample 580 may simulate the amount of tension experienced by the tubular string connection, depending on its location along a length of the tubular string when downhole. The tension load is generated by pushing on the second crosshead 520 by actuation of the piston cylinders 552 and rods 554, which in effect applies a pull force to the lower end of the test sample 580 via the end cap 582. The portion of the test sample 580 behind the expander 560 is thus tensioned by the opposing forces provided by the second actuation assembly 550 and the expander 560 via third actuation assembly 570. The tension load is maintained by adjusting the pressure supplied to the second actuation assembly 550 as the expander 560 moves through the test sample 580 and as the test sample 580 shrinks in length.

In one embodiment, the third actuation assembly 570 may include a piston cylinder 572 and a piston rod 574 that are operable to secure and/or move the expander 560 through the test sample 580. The piston cylinder 572 may be connected to the third crosshead 530 using a flanged connection, and the piston rod 574 may extend through openings in the third and first crossheads 530 and 510 and into the test sample 580. The piston cylinder 572 and rod 574 may be the same piston cylinder and rod 442 and 444 described above. The third actuation assembly 570 may be configured to constrain the expander 560 against the forces applied by the first and second actuation assemblies 540 and 550 to produce the loads in the test sample 580. The third actuation assembly 570 may also apply a pull force to move the expander 560 through the test sample 580. The pull force may be maintained by adjusting the pressure supplied to the third actuation assembly 570 as the expander 560 moves through the test sample 580 and as the test sample 580 shrinks in length. The piston rod 574 may be retracted into the piston cylinder 572 as the expander 560 moves through the test sample 580.

The application of the compression and tension loads by the first and second actuation assemblies 540 and 550 may be insufficient to move the expander 560 through the test sample 580. The test assembly 500 may apply calculated compression and tension loads to the test sample to simulate the run-in and un-expanded position of a tubular connection when located in a vertical, horizontal, or lateral wellbore. After the pre-loads are applied to the test sample 580, the third actuation assembly 570 may be actuated until the expansion force is reached to move the expander 560 through the test sample 580.

In one embodiment, the test assembly 500 may also be operable to supply fluid pressure into the chamber 586 to further place the length of the test sample 580 behind the expander 560 in tension to simulate the tensile load that would be generated by the thrust force of the fluid pressure. In one embodiment, a hydraulic fluid such as water may be supplied into the chamber 586 by a pump to generate the thrust force necessary to move the expander 560. The fluid pressure may be supplied through the flow bore of the piston rod 574. In one embodiment, the fluid pressure may be supplied to the sealed chamber 586 directly through a port in the test sample 580.

The combination of tension, compression, and fluid pressure are calculated to exceed the requisite expansion force necessary to expand the tubular test sample. During expansion, the loads provided by the actuation assemblies and the fluid pressure are continuously maintained according to a predetermined schedule as the expander 560 moves through and expands the test sample 580 to simulate the loads when downhole. In one embodiment, the predetermined schedule may include varying one or more of the tension and/or compression loads during expansion of the test sample 580. In one embodiment, the predetermined schedule may include maintaining one or more of the tension and/or compression loads constant during expansion of the test sample 580. In one embodiment, as the expander 560 moves through the test sample 580, the compressive load applied to the length of the test sample 580 ahead of the expander 560 remains the same and the tensile load applied to the length of the test sample 580 behind the expander 560 remains the same. To ensure a constant load, the fluid pressure and the pressures supplied to the piston cylinders 542, 552, and 572 and rods 544, 554, and 574 are adjusted to account for the application of the different loads and the changes in the lengths of the test sample 580 ahead of and behind the expander 560, as the expander 560 moves from one end to the other end. In one embodiment, the piston rod 554 of the second actuation assembly 550 may retract during expansion of the test sample 580 to accommodate for the shrinkage of the test sample 580, while maintaining the requisite tensile load on the test sample 580. In one embodiment, the test assembly 500 may be operable to accommodate for up to about a 10 percent shortening of the length of the test sample 580 during expansion. In one embodiment, one or more controllers may be used to automatically adjust the actuation pressure of the piston cylinders 542, 552, and 572 and the fluid pressure during expansion. In one embodiment, the predetermined schedule of loads applied to the expandable tubular may include provision for changing one or more of the applied loads during and/or after a section of the expandable tubular has been expanded. In one embodiment, the tension and compression loads applied to the expandable tubular may be permitted to change as a result of the expansion process while the expansion is being executed.

In one embodiment, all of the components of the test assembly 500 are controlled by a controller, such as a computer that continually monitors the loads that are to be maintained. As the expander 560, the piston rods 544, 554, and 574 and the first and second crossheads 510 and 520 move, the controller maintains the pressures inside the piston cylinders 542, 552, and 572 by pumping or removing hydraulic fluid. In one embodiment, the controller may include one or more pump controls that are configured to regulate the flow and pressure of hydraulic fluids to the piston cylinders 542, 552, and 572. In one embodiment, the controller may include one or more sensors, such as load cells, that are configured to communicate to the controller what the loads are in the test sample 580 during expansion. In one embodiment, the controller may be configured to continuously monitor and maintain the supply of fluid pressure to the test sample 580 to provide the thrust force necessary to move the expander 560.

The test assembly 500 is operable to accurately simulate numerous variations of a "fixed-free" or a "fixed-fixed" expansion. In one embodiment, the test sample 580 can be expanded using one or more combinations of the first, second, and third actuation assemblies and fluid pressure. In one embodiment, the test sample 580 can be constrained at both ends to prevent the test sample 580 from length shrinkage during expansion. In one embodiment, the different tension and compression forces can be applied to the test sample 580 in any order.

In one embodiment, the test assembly 500 may be operable to expand test samples within a range of about 3½ inches in diameter to about 13⅜ inches or about 16 inches in diameter. In one embodiment, the test assembly 500 may include a pump system operable to supply up to about 10,000 PSI into the test sample. In one embodiment, the test assembly 500 is operable to move the expander 560 through the test sample 580 at a speed up to about 10 feet per minute.

Figure 6A:
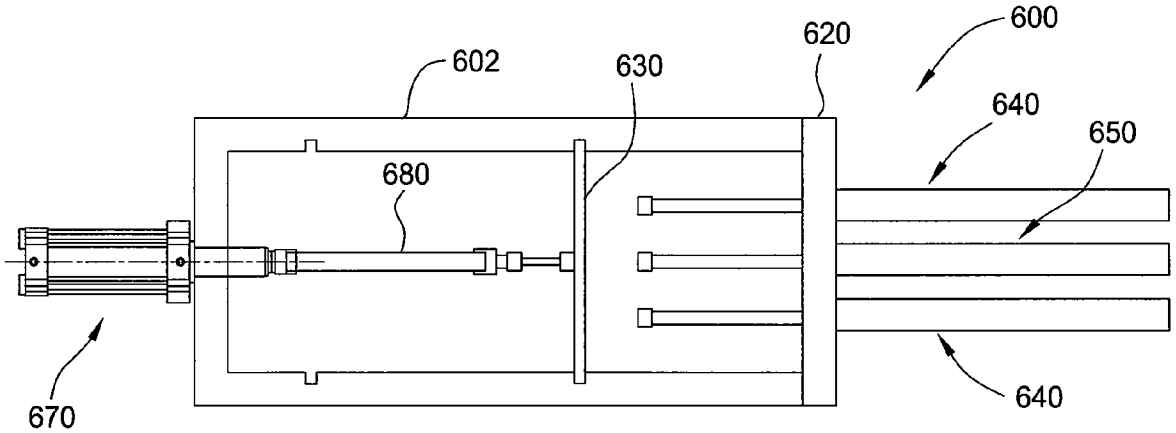
FIGS. 6A and 6B illustrate an embodiment of a test assembly for expanding a tubular connection.
Figure 6B:
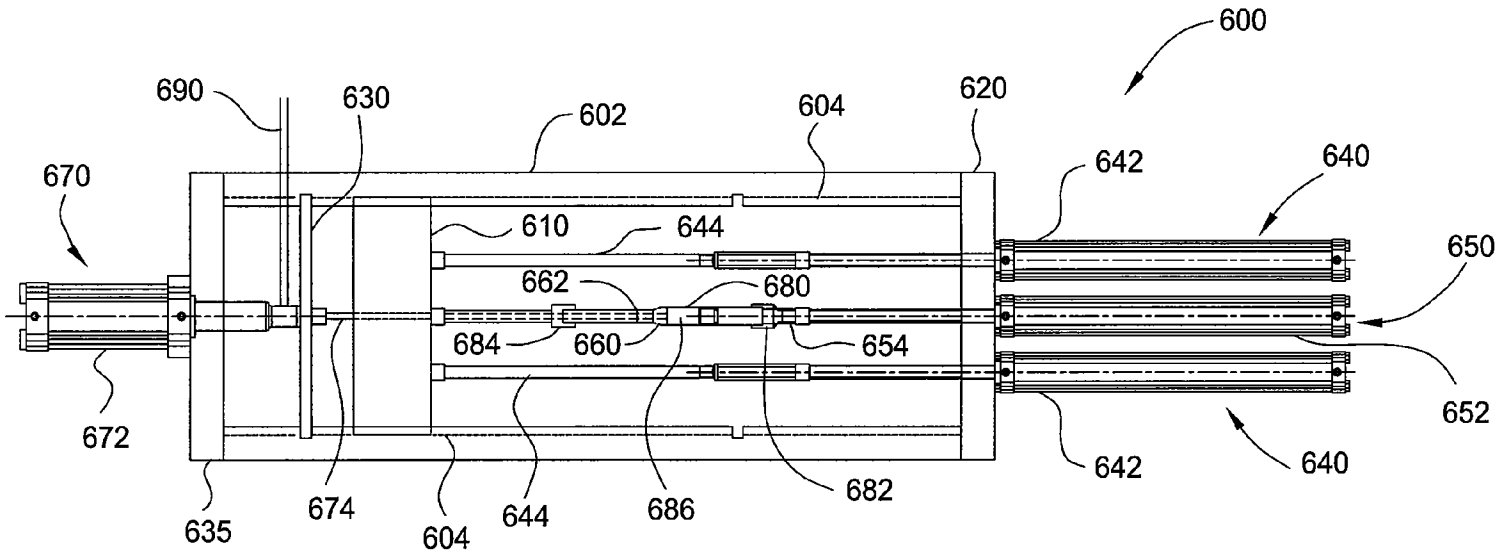

FIGS. 6A and 6B illustrate a test assembly 600 for expanding a tubular string having one or more connections, according to one or more of the test configurations 100, 200, 300, and 800 described herein. The embodiments, described above with respect to the test assemblies 400 and 500 may also be provided using the test assembly 600. FIG. 6A illustrates the test assembly 600 in a load or test configuration, and FIG. 6B illustrates the test assembly 600 in a combination expansion configuration.

The test assembly 600 may include a rectangular frame 602, having one or more rails 604, for supporting a first crosshead 610, a second crosshead 620, a third crosshead 630, and a fourth crosshead 635. The first crosshead 610 may be movable relative to the frame 602 along the rails 604. The second, third, and fourth crossheads 620, 630, and 635 may be stationary and fixed to the frame 602. The second and fourth crossheads 620 and 635 may integral with the frame 602, such as the ends of the frame 602. The third crosshead 630 may be fixed to the frame 602 at different locations depending on whether the test assembly 600 is used in the load or test configuration as shown in FIG. 6A or in the combination expansion configuration shown in FIG. 6B. The test assembly 600 also includes one or more first actuation assemblies 640 configured to apply a first load to a test sample 680, one or more second actuation assemblies 650 configured to apply a second load to the test sample 680, and one or more third actuation assemblies 670 configured to apply a third load to the test sample 680.

As illustrated in FIG. 6A, a test sample 680 may be secured at one end to the third crosshead 630 and at the other end to the fourth crosshead 635 via the third actuation assembly 670. In one embodiment, the third actuation assembly 670 may be a 1.5M lb-load cylinder. The test sample 680 may be an unexpanded tubular string having one or more connections or an expanded tubular string having one or more expanded connections. In this configuration, a tension or a compression load may be applied to the test sample 680 by actuation of the third actuation assembly 670. The test assembly 600 may therefore be used to test and analyze the structural integrity of the test sample 680 before and/or after expansion.

As illustrated in FIG. 6B, the test assembly 600 may further include an expander 660, such as a cone, that is connected to the third and/or fourth crossheads 630 and 635 via a piston rod 674. The piston rod 674 may be a tubular member or connecting rod having a flow bore therethrough. The piston rod 674 may extend through an opening in the first crosshead 610 and into the test sample 680. Fluid communication to the test sample 680 may be established through the flow bore of the piston rod 674. The expander 660 may be connected to the lower end of the piston rod 674 and positioned within the test sample 680. The expander 660 may be provided with one or more seals 662, such as seal cups, to form a sealed chamber 686 within the test sample 680. The test sample 680 may include an expandable tubular string having one or more expandable tubular members that are connected together by one or more threaded connections. The upper end of the test sample 680 may be connected to an end cap 684 that is supported by the first crosshead 610, and the lower end of the test sample 680 may be closed and/or sealingly connected to an end cap 682 that is supported by the second actuation assembly 650.

In one embodiment, the first actuation assembly 640 may include a pair of piston cylinders 642 and piston rods 644 that are operable to move the first crosshead 610. The piston cylinders 642 may be connected to the second crosshead 620 using one or more flanged connections, and the piston rods 644 may be connected to the first crosshead 610 in a similar manner. The piston cylinders 642 and rods 644 may be the same piston cylinders and rods 442 and 444 described above. The first actuation assembly 640 is configured to apply a compressive force to the test sample 680. Placing the test sample 680 in compression simulates a compressive load generated by tubular string weight that places a tubular string connection in compression when supported downhole. The amount of compression applied to the test sample 680 may simulate the amount of compression experienced by the tubular string connection, depending on its location along a length of the tubular string when downhole. The compression load is generated by pulling the first crosshead 610 by actuation of the piston cylinders 642 and rods 644. The portion of the test sample 680 ahead of the expander 660 may thus be compressed between the end cap of the first crosshead 610 and the expander 660, which is secured by the third and/or fourth crossheads via the third actuation assembly 670. The compression load is maintained by adjusting the pressure supplied to the first actuation assembly 640 as the expander 660 moves through the test sample 680 and as the test sample 680 shrinks in length.

In one embodiment, the second actuation assembly 650 may include a piston cylinder 652 and a piston rod 654 that are operable to apply a load to the test sample 680. The piston cylinder 652 may be connected to the second crosshead 620 using one or more flanged connections, and the piston rod 654 may be connected to test sample 680 via the end cap 682. The piston cylinder 652 and rod 654 may be the same piston cylinder and rod 452 and 454 described above. The second actuation assembly 650 is configured to apply a tensile force to the test sample 680. Placing the test sample 680 in tension simulates a tensile load generated by tubular string weight that places a tubular string connection in tension when supported downhole. The amount of tension applied to the test sample 680 may simulate the amount of tension experienced by the tubular string connection, depending on its location along a length of the tubular string when downhole. The tension load is generated by pulling on the test sample 680 by actuation of the piston cylinder 652 and rod 654. The portion of the test sample 680 behind the expander 660 may thus be tensioned by the opposing forces provided by the second actuation assembly 650 and the expander 660 via the third actuation assembly 670. The tension load is maintained by adjusting the pressure supplied to the second actuation assembly 650 as the expander 660 moves through the test sample 680 and as the test sample 680 shrinks in length.

In one embodiment, the third actuation assembly 670 may include a piston cylinder 672 and a piston rod 674 that are operable to secure and/or move the expander 660 through the test sample 680. The piston cylinder 672 may be connected to the fourth crosshead 635 using a flanged connection, and the piston rod 674 may extend through openings in the third and first crossheads 630 and 610 and into the test sample 680. The piston cylinder 672 and rod 674 may be the same piston cylinder and rod 442 and 444 described above. The third actuation assembly 670 may be configured to constrain the expander 660 against the forces applied by the first and second actuation assemblies 640 and 650 to produce the loads in the test sample 680. The third actuation assembly 670 may also apply a pull force to move the expander 660 through the test sample 680. The pull force may be maintained by adjusting the pressure supplied to the third actuation assembly 670 as the expander 660 moves through the test sample 680 and as the test sample 680 shrinks in length. The piston rod 674 may be retracted into the piston cylinder 672 as the expander 660 moves through the test sample 680.

The application of the compression and tension loads by the first and second actuation assemblies 640 and 650 may be insufficient to move the expander 660 through the test sample 680. The test assembly 600 may apply calculated compression and tension loads to the test sample 680 to simulate the run-in and un-expanded position of a tubular connection when located in a vertical, horizontal, or lateral wellbore. After the pre-loads are applied to the test sample 680, the third actuation assembly 670 may be actuated until the expansion force is reached to move the expander 660 through the test sample 680.

In one embodiment, the test assembly 600 may also be operable to supply fluid pressure into the chamber 686 via a pump 690 to further place the length of the test sample 680 behind the expander 660 in tension to simulate the tensile load that would be generated by the thrust force of the fluid pressure. In one embodiment, a hydraulic fluid such as water may be supplied into the chamber 686 by the pump 690 to generate the thrust force necessary to move the expander 660. The fluid pressure may be supplied through the flow bore of the piston rod 674. In one embodiment, the fluid pressure may be supplied to the chamber 686 directly through a port in the test sample 680.

The combination of tension, compression, and fluid pressure are calculated to exceed the requisite expansion force necessary to expand the tubular test sample. During expansion, the loads provided by the actuation assemblies and the fluid pressure are continuously maintained according to a predetermined schedule as the expander 660 moves through and expands the test sample 680 to simulate the loads when downhole. In one embodiment, the predetermined schedule may include varying one or more of the tension and/or compression loads during expansion of the test sample 680. In one embodiment, the predetermined schedule may include maintaining one or more of the tension and/or compression loads constant during expansion of the test sample 680. In one embodiment, as the expander 660 moves through the test sample 680, the compressive load applied to the length of the test sample 680 ahead of the expander 660 remains the same and the tensile load applied to the length of the test sample 680 behind the expander 660 remains the same. To ensure a constant load, the fluid pressure and the pressures supplied to the piston cylinders 642, 652, and 672 and rods 644, 654, and 674 are adjusted to account for the application of the different loads and the changes in the lengths of the test sample 680 ahead of and behind the expander 660, as the expander 660 moves from one end to the other end. In one embodiment, the piston rod 654 of the second actuation assembly 650 may extend during expansion of the test sample 680 to accommodate for the shrinkage of the test sample 680, while maintaining the requisite tensile load on the test sample 680. In one embodiment, the test assembly 600 may be operable to accommodate for up to about a 10 percent shortening of the length of the test sample 680 during expansion. In one embodiment, one or more controllers may be used to automatically adjust the actuation pressure of the piston cylinders 642, 652, and 672 and the fluid pressure during expansion. In one embodiment, the predetermined schedule of loads applied to the expandable tubular may include provision for changing one or more of the applied loads during and/or after a section of the expandable tubular has been expanded. In one embodiment, the tension and compression loads applied to the expandable tubular may be permitted to change as a result of the expansion process while the expansion is being executed.

In one embodiment, all of the components of the test assembly 600 are controlled by a controller, such as a computer that continually monitors the loads that are to be maintained. As the expander 660, the piston rods 644, 654, and 674 and the first crosshead 610 move, the controller maintains the pressures inside the piston cylinders 642, 652, and 672 by pumping or removing hydraulic fluid. In one embodiment, the controller may include one or more pump controls that are configured to regulate the flow and pressure of hydraulic fluids to the piston cylinders 642, 652, and 672. In one embodiment, the controller may include one or more sensors, such as load cells, that are configured to communicate to the controller what the loads are in the test sample 680 during expansion. In one embodiment, the controller may be configured to continuously monitor and maintain the supply of fluid pressure to the test sample 680 to provide the thrust force necessary to move the expander 660.

The test assembly 600 is operable to accurately simulate numerous variations of a "fixed-free" or a "fixed-fixed" expansion. In one embodiment, the test sample 680 can be expanded using one or more combinations of the first, second, and third actuation assemblies and fluid pressure. In one embodiment, the test sample 680 can be constrained at both ends to prevent the test sample 680 from length shrinkage during expansion. In one embodiment, the different tension and compression forces can be applied to the test sample 680 in any order.

In one embodiment, the test assembly 600 may be operable to expand test samples within a range of about 3½ inches in diameter to about 13⅜ inches or about 16 inches in diameter. In one embodiment, the test assembly 600 may include a pump system operable to supply up to about 10,000 PSI into the test sample. In one embodiment, the test assembly 600 is operable to move the expander 660 through the test sample 680 at a speed up to about 10 feet per minute.

Figure 7A:
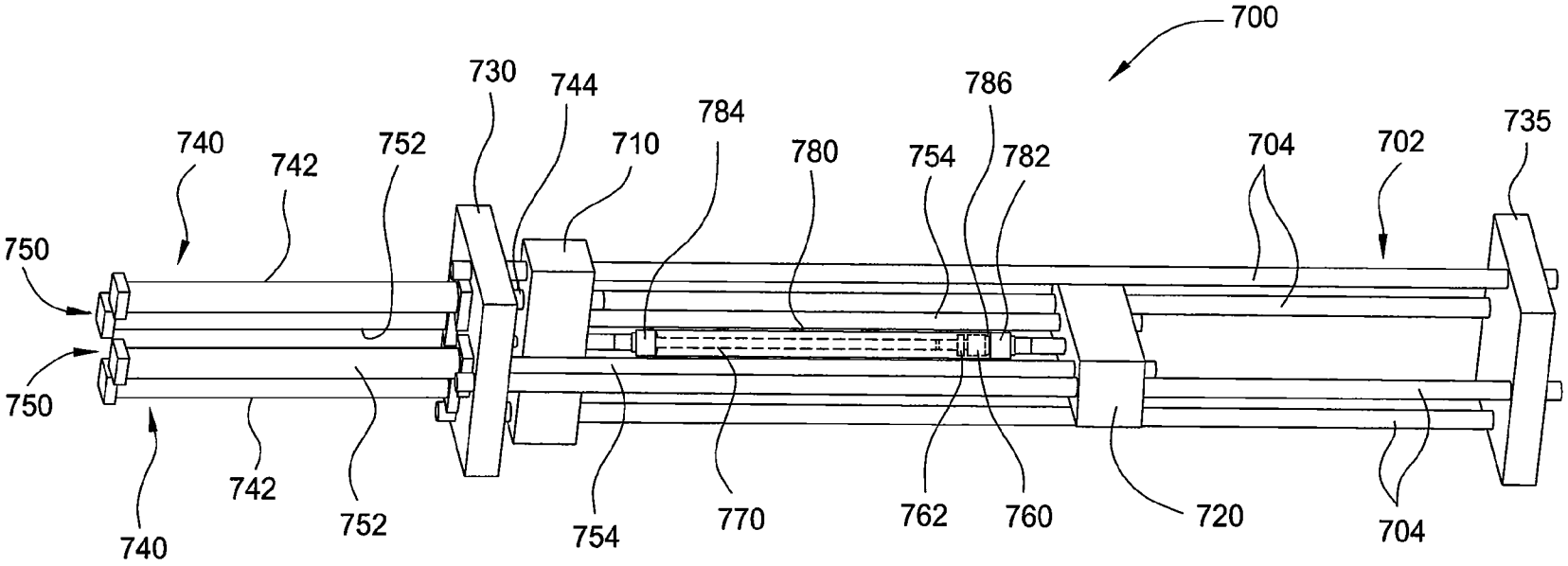
FIGS. 7A and 7B illustrate an embodiment of a test assembly for expanding a tubular connection.
Figure 7B:
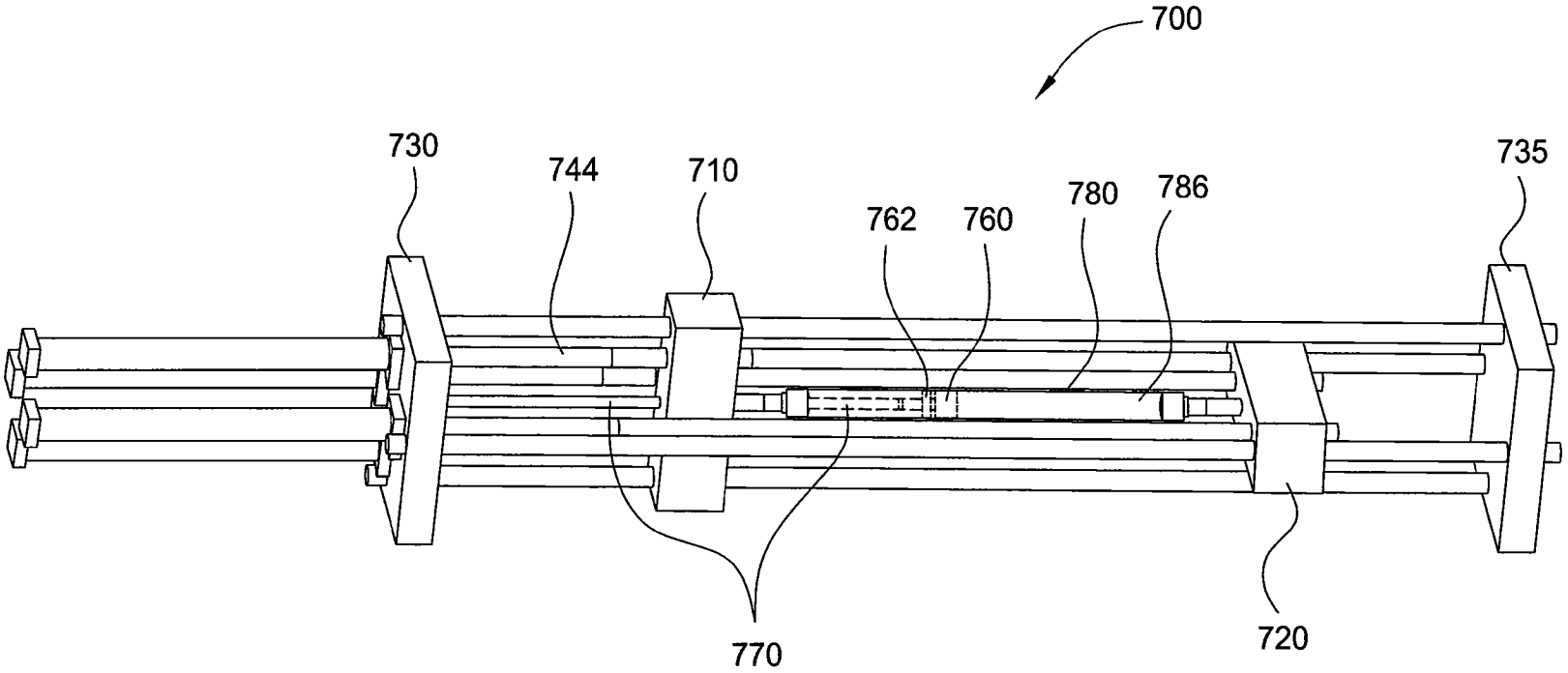

FIGS. 7A and 7B illustrate a test assembly 700 for expanding a tubular string having one or more connections, according to one or more of the test configurations 100, 200, 300, and 800 described herein. The embodiments, described above with respect to the test assemblies 400, 500, and 600 may also be provided using the test assembly 700. The test assembly 700 is operable to apply and maintain tension and compression loads on a first length of a tubular string located in front of an expander and a second length of the tubular string located behind the expander, while the expander expands the tubular. The test assembly 700 is thus operable to accurately simulate the expansion of tubular string connections under downhole conditions.

The test assembly 700 may include a frame 702 having four symmetrically positioned rails 704 for supporting a first crosshead 710, a second crosshead 720, a third crosshead 730, and a fourth crosshead 735. The first and second crossheads 710 and 720 may be movable along different sets of the rails 704, and the third and fourth crossheads 730 and 735 may be stationary and fixed to all four of the rails 704. The test assembly 700 also includes one or more first actuation assemblies 740 configured to apply a first load to a test sample 780, and one or more second actuation assemblies 750 configured to apply a second load to the test sample 780. The test assembly 700 further includes an expander 760, such as a cone, that is connected a work string 770. The work string 770 may be a tubular member or connecting rod having a flow bore therethrough. The work string 770 is connected to the third crosshead 730 and may extend through an opening in the first crosshead 710 into the test sample 780. Fluid communication to the test sample 780 may be established through the flow bore of the work string 770. The expander 760 may be connected to the lower end of the work string 770 and positioned within the test sample 780. The expander 760 may be provided with one or more seals 762, such as seal cups, to form a sealed chamber 786 within the test sample 780. The test sample 780 may include an expandable tubular string having one or more expandable tubular members that are connected together by one or more threaded connections. The upper end of the test sample 780 may be connected to an end cap 784 that is supported by the first crosshead 710, and the lower end of the test sample 780 may be closed and/or sealingly connected to an end cap 782 that is supported by the second crosshead 720.

In one embodiment, the first actuation assembly 740 may include a pair of piston cylinders 742 and piston rods 744 that are operable to move the first crosshead 710 along a first set of the rails 704. The piston cylinders 742 may be connected to the third crosshead 730 using one or more flanged connections, and the piston rods 744 may be extend through openings in the third crosshead 730 and connect to the first crosshead 710. The piston cylinders 742 and rods 744 may be the same piston cylinders and rods 442 and 444 described above. The first actuation assembly 740 is configured to apply a compressive force to the test sample 780. Placing the test sample 780 in compression simulates a compressive load generated by tubular string weight that places a tubular string connection in compression when supported downhole. The amount of compression applied to the test sample 780 may simulate the amount of compression experienced by the tubular string connection, depending on its location along a length of the tubular string when downhole. The compression load is generated by pushing the first crosshead 710 by actuation of the piston cylinders 742 and rods 744. The portion of the test sample 780 ahead of the expander 760 may thus be compressed between the end cap 784 of the first crosshead 710 and the expander 760, which is secured by the third crosshead 730 via the work string 770. The compression load is maintained by adjusting the pressure supplied to the first actuation assembly 740 as the test sample 780 is moved over the expander 760 and as the test sample 780 shrinks in length.

In one embodiment, the second actuation assembly 750 may include a pair of piston cylinders 752 and piston rods 754 that are operable to move the second crosshead 720 along a second set of the rails 704. The piston cylinders 752 may be connected to the third crosshead 730 using one or more flanged connections, and the piston rods 754 may extend through openings in the third crosshead 730 and connect to the second crosshead 720. The piston cylinders 752 and rods 754 may be the same piston cylinders and rods 452 and 454 described above. The second actuation assembly 750 is configured to apply a tensile force to the test sample 780. Placing the test sample 780 in tension simulates a tensile load generated by tubular string weight that places a tubular string connection in tension when supported downhole. The amount of tension applied to the test sample 780 may simulate the amount of tension experienced by the tubular string connection, depending on its location along a length of the tubular string when downhole. The tension load is generated by pushing on the second crosshead 720 by actuation of the piston cylinders 752 and rods 754, which in effect applies a pull force to the lower end of the test sample 780 via the end cap 782. The portion of the test sample 780 behind the expander 760 may thus be tensioned by the opposing forces provided by the second actuation assembly 750 and the secured connection of the expander 760 to the third crosshead 730 via the work string 770. The tension load is maintained by adjusting the pressure supplied to the second actuation assembly 750 as the test sample 780 is moved over the expander 760 and as the test sample 780 shrinks in length.

The application of the compression and tension loads by the first and second actuation assemblies 740 and 750 may be insufficient to move the test sample 780 over the expander 760. The test assembly 700 may apply calculated compression and tension loads to the test sample to simulate the run-in and un-expanded position of a tubular connection when located in a vertical, horizontal, or lateral wellbore. After the pre-loads are applied to the test sample 780, fluid pressure may be continuously supplied through the flow bore of the work string 770 into the sealed chamber 786 until the expansion force is reached to move the test sample 780 over the expander 760. In one embodiment, the fluid pressure may be supplied to the chamber 786 directly through a port in the test sample 780. Supplying fluid pressure into the chamber 786 may further place the length of the test sample 780 behind the expander 760 in tension to simulate the tensile load that would be generated by the thrust force of the fluid pressure. In one embodiment, a hydraulic fluid such as water may be supplied into the chamber 786 by a pump to generate the thrust force.

The combination of tension, compression, and fluid pressure are calculated to exceed the requisite expansion force necessary to expand the tubular test sample. During expansion, the loads provided by the actuation assemblies and the fluid pressure are continuously maintained according to a predetermined schedule as the test sample 780 is moved over the expander 760 and is expanded to simulate the loads when downhole. In one embodiment, the predetermined schedule may include varying one or more of the tension and/or compression loads during expansion of the test sample 780. In one embodiment, the predetermined schedule may include maintaining one or more of the tension and/or compression loads constant during expansion of the test sample 780. In one embodiment, as the expander 760 passes through the test sample 780, the compressive load applied to the length of the test sample 780 ahead of the expander 760 remains the same and the tensile load applied to the length of the test sample 780 behind the expander 760 remains the same. To ensure a constant load, the fluid pressure and the pressures supplied to the piston cylinders 742 and 752 and piston rods 744 and 754 are adjusted to account for the application of the different loads and the changes in the lengths of the test sample 780 ahead of and behind the expander 760, as the expander 760 passes from one end to the other end. In one embodiment, at least one of the piston rods 744 and 754 of the actuation assemblies may be operable to adjust the spacing between the first and second crossheads 710 and 720 during expansion of the test sample 780 to accommodate for the shrinkage of the test sample 780, while maintaining the requisite loads on the test sample 780. In one embodiment, the test assembly 700 may be operable to accommodate for up to about a 10 percent shortening of the length of the test sample 780 during expansion. In one embodiment, one or more controllers may be used to automatically adjust the actuation pressure of the piston cylinders 742 and 752 and the fluid pressure during expansion. In one embodiment, the predetermined schedule of loads applied to the expandable tubular may include provision for changing one or more of the applied loads during and/or after a section of the expandable tubular has been expanded. In one embodiment, the tension and compression loads applied to the expandable tubular may be permitted to change as a result of the expansion process while the expansion is being executed.

In one embodiment, all of the components of the test assembly 700 are controlled by a controller, such as a computer that continually monitors the loads that are to be maintained. As the test sample 780, the piston rods 744 and 754, and the first and second crossheads 710 and 720 move, the controller maintains the pressures inside the piston cylinders 742 and 752 by pumping or removing hydraulic fluid. In one embodiment, the controller may include one or more pump controls that are configured to regulate the flow and pressure of hydraulic fluids to the piston cylinders 742 and 752. In one embodiment, the controller may include one or more sensors, such as load cells, that are configured to communicate to the controller what the loads are in the test sample 780 during expansion. In one embodiment, the controller may be configured to continuously monitor and maintain the supply of fluid pressure to the test sample 780 to provide force necessary to move the test sample 780 over the expander 760.

The test assembly 700 is operable to accurately simulate numerous variations of a "fixed-free" or a "fixed-fixed" expansion. In one embodiment, the test sample 780 can be expanded using one or more combinations of the first and second actuation assemblies and the fluid pressure. In one embodiment, the test sample 780 can be constrained at both ends by locking the spacing between the first and second crossheads 710 and 720 to prevent the test sample 780 from length shrinkage during expansion. In one embodiment, the different tension and compression forces can be applied to the test sample 780 in any order.

In one embodiment, the test assembly 700 may be operable to expand test samples within a range of about 3½ inches in diameter to about 13⅜ inches or about 16 inches in diameter. In one embodiment, the test assembly 700 may include a pump system operable to supply up to about 10,000 PSI into the test sample. In one embodiment, the test assembly 700 is operable to move the test sample 780 over the expander 760 at a speed up to about 10 feet per minute.

FIG. 7B illustrates the test sample 780 in an expanded state. As illustrated, the first and second actuation assemblies 740 and 750 and the fluid pressure supplied to the chamber 786 have moved the test sample over the expander 760. The expander 760 remains in a stationary position and the first and second crossheads 710 and 720, which are secured to the test sample 780, are moved along the rails 704 to move the test sample 780 over the expander 760. The test assembly 700 is operable to move the entire length of the test sample 780 over the expander 760. The spacing between the first and second crossheads 710 and 720 may be adjusted to accommodate for a variety of lengths of test samples 780.

In one embodiment, each of the actuation assemblies of the test assemblies 400, 500, 600, and 700 may be operable to apply both a tensile load and a compressive load to the test samples. Each of the test assemblies 400, 500, 600, and 700 may thus have the flexibility to expand a test sample in one or more different configurations by controlling, adjusting, and/or changing the operation of the actuation assemblies. Each of the test assemblies 400, 500, 600, and 700 may therefore be arranged according to at least the test configurations 100, 200, 300, and 800 shown in FIGS. 1-3 and 8.

FIG. 8 illustrates the fourth test configuration 800 for simulating the downhole expansion of a tubular connection. The fourth test configuration 800 includes a tubular 810, a work string 820 extending through the tubular 810, and an expander 830 disposed within a lower end of the tubular and connected to the end of the work string 820. The tubular 810 may include one or more tubular members connected together by one or more connections. A first load 850, a second load 840, and a third load 860 may be applied to the tubular 810 during expansion of the tubular 810. The first load 850 may be applied to a first end of the tubular 810. In one embodiment, the first load 850 may be applied to the tubular 810 by one or more ways known by one of ordinary skill in the art. In one embodiment, the first load 850 may be applied to the tubular 810 using one or more piston cylinders. The first load 850 is applied to the tubular 810 to thereby compress a length 812 of the tubular against the expander 830, which is constrained by the second load 840 that is applied to the work string 820. Placing the length 812 of the tubular in compression simulates a compressive load generated by weight of a tubular string that places a connection of the tubular string in compression when supported downhole. The amount of compression applied to the length 812 may simulate the amount of compression experienced by a tubular string connection, depending on its location along a length of a tubular string when downhole. The third load 860 may be applied to the lower end of the tubular 810 in a similar manner as the second load 160 described above. The third load 860 places a length 814 of the tubular behind the expander 830 in tension, as the expander 830 is constrained by the second load 840 that is applied to the work string 820. Placing the length 814 of the tubular in tension simulates a tensile load generated by weight of a tubular string that places a connection of the tubular string in tension when supported downhole. The amount of tension applied to the length 814 may simulate the amount of tension experienced by a tubular string connection, depending on its location along a length of a tubular string when downhole. The second load 840 may be applied to an end of the work string 820 in a similar manner as the first load 150 described above, to secure and/or move the expander 830 through the tubular 810. The second load 840 may be configured to constrain the expander 830 against the forces applied by the first and third loads 850 and 860 to produce the loads in the tubular 810. The second load 840 may also apply a pull force to move the expander 830 through the tubular 810. In one embodiment, the application of the first, second, and/or third loads may be insufficient to move the expander 830 through the tubular 810 (or move the tubular 810 over the expander 830). In one embodiment, the first, second, and third loads may be pre-determined and may remain constant during expansion of the tubular 810.

Prior to expansion, the fourth test configuration 800 may apply calculated first, second, and third loads 850, 840, and 860 to the tubular 810 to simulate the run-in and un-expanded position of a tubular connection when located in a vertical, horizontal, and/or lateral wellbore. After the applicable loads are applied to the tubular 810, fluid pressure may then be supplied through the work string 810 into a sealed chamber 816, formed between the expander 830 and the lower end of the tubular 810, to move the expander 830 through the tubular 810 (or move the tubular 810 over the expander 830). In one embodiment, the fluid pressure may be supplied to the sealed chamber 816 directly through a port in the tubular 810. Supplying fluid pressure into the chamber 816 may further place the length 814 of the tubular behind the expander 830 in tension to simulate the tensile load that would be generated by the thrust force of the fluid pressure. In one embodiment, the loads may be applied to the tubular 810 upon and/or as a result of expansion of the tubular.

The combination of tension, compression, and fluid pressure are calculated to exceed the requisite expansion force necessary to expand the tubular 810. During expansion, the first, second, and third loads 850, 840, and 860 and the fluid pressure are continuously maintained according to a predetermined schedule as the expander 830 moves through and expands the tubular 810 (or the tubular 810 moves over the expander 830 and is expanded) to simulate the tension and compression loads in the tubular when downhole. In one embodiment, as the expander 830 moves through the tubular 810 (or the tubular 810 moves over the expander 830), the compressive load applied to the length 812 of the tubular remains constant and the tensile load applied to the length 814 of the tubular remains constant. To ensure a constant load, the mechanism used to provide the first load 850 is continuously adjusted to account for the application of the second and third loads 840 and 860 and the fluid pressure, and vice versa. The mechanisms used to provide the first load 850, the second load 840, the third load 860, and the fluid pressure are adjusted to account for the changes in the length 812 and 814 of the tubular 810 located ahead of and behind the expander 830 as it moves from one end to the other end. Adjustments may also be made to account for the shrinkage of the tubular 810 during expansion. In one embodiment, one or more controllers may be used to automatically adjust the mechanisms used to provide the first, second, and third loads 850, 860, and 840 and the fluid pressure during expansion. In one embodiment, the predetermined schedule of loads applied to the expandable tubular may include provision for changing one or more of the applied loads during and/or after a section of the expandable tubular has been expanded. In one embodiment, the tension and compression loads applied to the expandable tubular may be permitted to change as a result of the expansion process while the expansion is being executed.

Figure 9A:
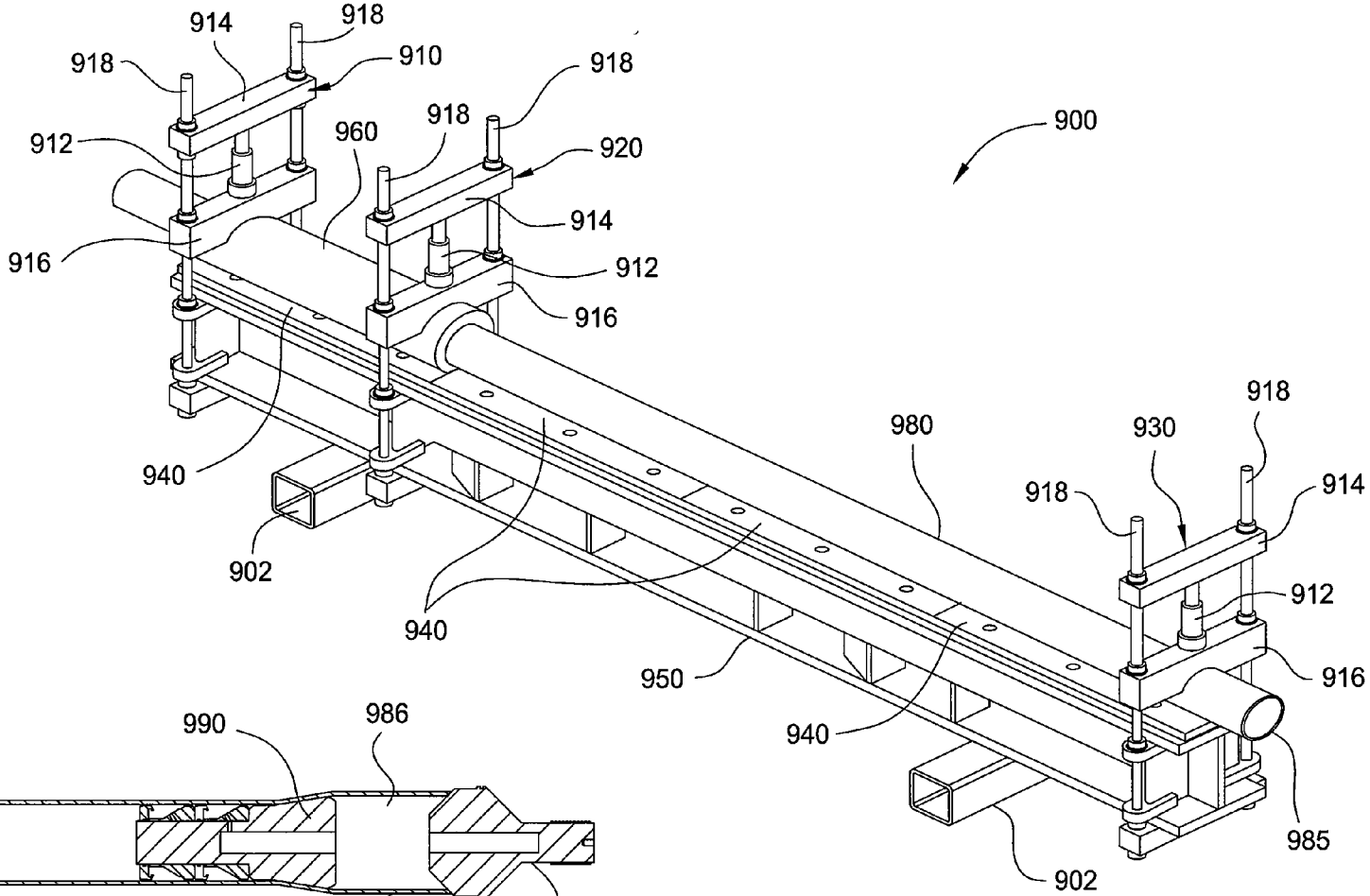
FIGS. 9A and 9B illustrate an embodiment of a bending assembly for bending a tubular having one or more connections.

FIG. 9A illustrates one embodiment of a bending assembly 900 that may be used with one or more of the test assemblies described herein to help simulate the expansion of a tubular connection in a deviated or curved wellbore. The bending assembly 900 includes a first fixture 910, a second fixture 920, and a third fixture 930, which are used to secure a test sample 980 onto a curved support surface 940 of the assembly 900 to provide a bend in the test sample 980. The test sample 980 may include an expandable tubular having one or more connections, such as threaded connections. The curved support surface 940 may be in the form of a curve, arc, or other similar shape such that the ends of the surface are tapered at an angle relative to a crest of the surface, which may be located at a middle portion of the surface between the ends. In one embodiment, the curved support surface 940 may include a plurality of plates having machined surfaces that form the curved support surface 940. The plates 940 may be secured to a support member 950, such as an I-beam, and may be replaceable to change the bend radius of the curved support surface 940. In one embodiment, the curved support surface 940 may include a bend angle in a range of about 1 degree to about 30 degrees, including a range of about 5 degrees to about 15 degrees.

The first, second, and third fixtures 910, 920, and 930 are used to force the test sample 980 against the curved support surface 940 to create a bend in the test sample 980. In one embodiment, the bend in the test sample 980 may have a constant bend radius. Other, varying bend radii are also contemplated. The first and second fixtures 910 and 920 may secure the test sample 980 to the curved plates 940 and the support member 950 via a cylindrical sleeve 960. The portion of the cylindrical sleeve 960 that contacts the curved support surface 940 may include a machined flat section to help ensure a constant bend radius when contacting the support surface. The cylindrical sleeve 960 supports one end of the test sample 980 to allow the test sample 980 to move or shorten in length during expansion. In one embodiment, the first, second, and third fixtures 910, 920, and 930 may each include a (hydraulic, pneumatic, and/or electric) piston-cylinder arrangement 912 disposed between a fixed support member 914 and a movable support member 916, which are supported by guide rails 918, for applying a force to the test sample 980. Upon actuation, the piston-cylinder arrangement 912 may react against the fixed support member 914 and force the movable support member 916 against the test sample 980 and the curved support surface 940. In one embodiment, the fixtures 910, 920, and 930 may be mechanically actuated, such as with a threaded configuration, to force the test sample 980 against the curved support surface 940.

Figure 9B:
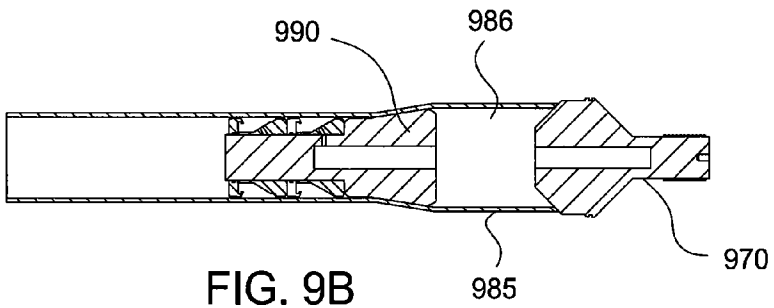

FIG. 9B illustrates a cross-sectional view of an end 985 of the test sample 980. FIG. 9B shows an expander 990 installed in the test sample 980 and an end cap 970 that is connected to the end 985 of the test sample 980 to form a sealed chamber 986 therebetween. The end cap 970 may be used to facilitate connection of the bending assembly 900 and the test sample 980 to any one of the test assemblies described herein. The expander 990 could then be pressurized and/or pulled through the test sample 980 to expand the test sample 980. The pressure could be released before the expander 990 reaches the cylindrical sleeve 960.

In one embodiment, the test assemblies 400, 500, 600, 700, and 800 may be configured to simulate downhole expansion in a wellbore deviation using the bending assembly 900. Prior to expansion a test sample may be provided with a bend using the bending assembly 900. The test sample and bending assembly 900 may be connected to the test assemblies using threaded connections, tubing adapters, and/or swivel arrangements. The swivel arrangement may allow the application of compression and/or tension loads to the bent test sample while preventing straightening of the test sample. A tensile load may be generated in the test sample on one side of the bend and/or a compression load may be generated in the test sample on the other side of the bend. The test sample may then be expanded as described above, with or without the addition of fluid pressure and in a fixed-free and/or fixed-fixed configuration, while maintaining the constant bend radius in the test sample and the one or more loads applied to the test sample. The test assemblies are thus operable to simulate the downhole expansion of a tubular connection when in a deviated or curved wellbore.

Figure 10B:
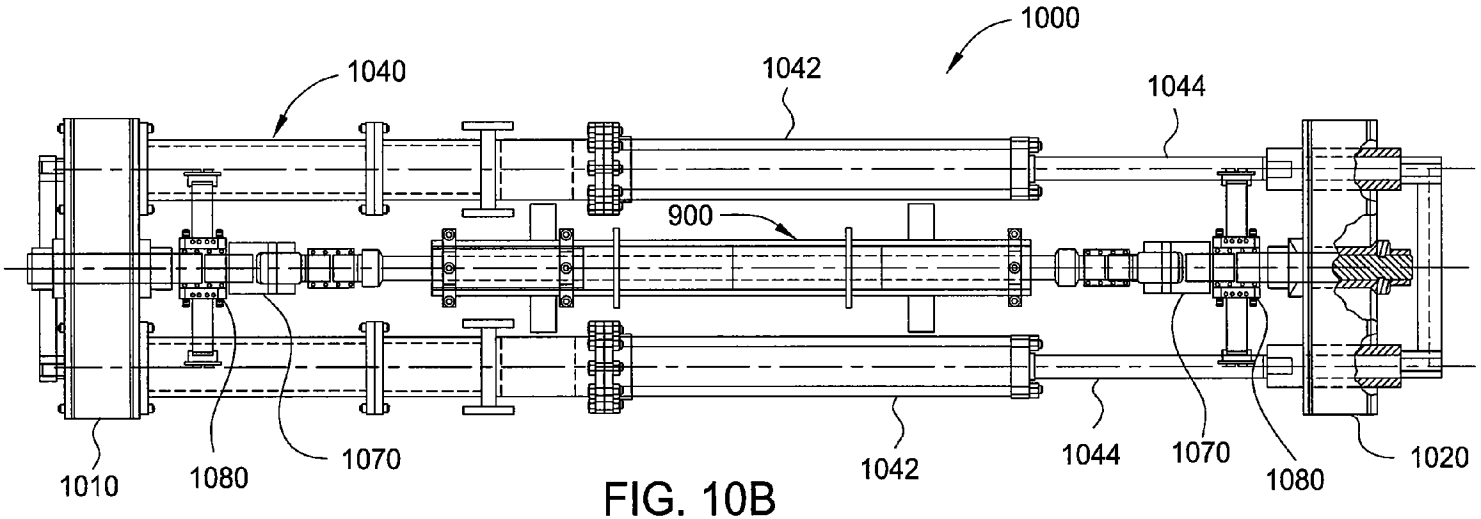
FIGS. 10A and 10B illustrate an embodiment of a testing assembly and the bending assembly for expanding and bending a tubular having one or more connections.
Figure 10A:
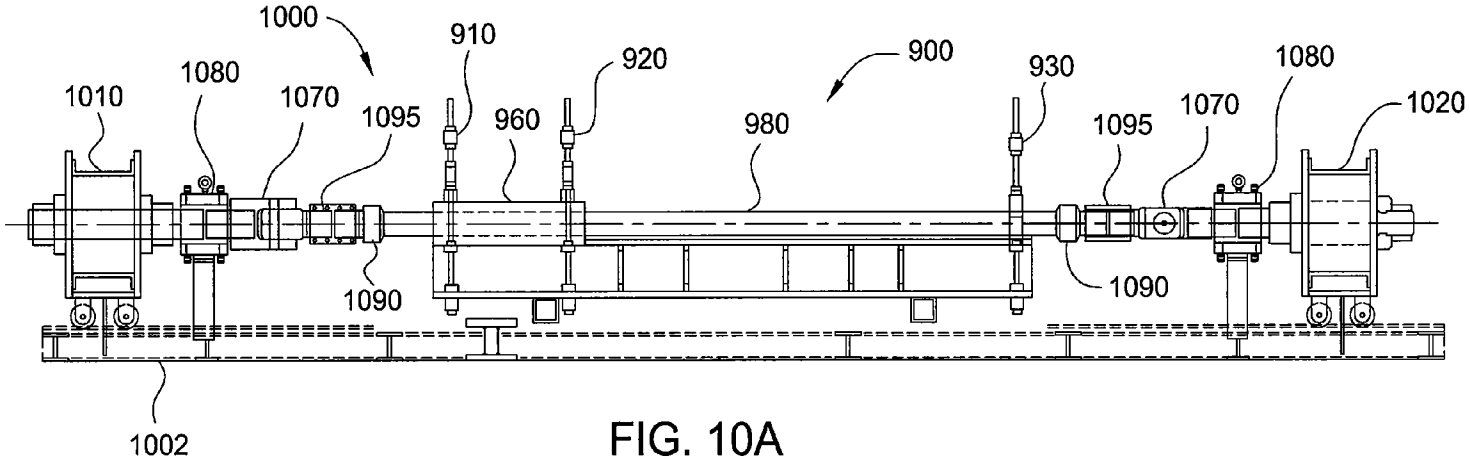

FIGS. 10A and 10B illustrate a top view and a side view, respectively, of a test assembly 1000 and the bending assembly 900 secured thereto. The test assembly 1000 includes a frame 1002, a first crosshead 1010, a second crosshead 1020, and a first actuation assembly 1040. The test sample 980 may be secured to the bending assembly 900 as described above. The test sample 980 may also be secured to the first and second crossheads 1010 and 1020 using one or more end caps 1090, threaded adapters 1095, and/or swivels 1070 to accommodate for the curved ends of the test sample 980. One or more buckling assemblies 1080 may also be provided as part of the test assembly 1000 to prevent bucking of the test sample 980 and/or the additional support/connection members used to connect the test sample 980 to the test assembly 1000.

In one embodiment, the first actuation assembly 1040 may include a pair of piston cylinders 1042 and piston rods 1044, similar to the actuation assemblies described above. The piston cylinders 1042 may be connected to the first crosshead 1010 using one or more flanged connections, and the piston rods 1044 may be connected to the second crosshead 1020 in a similar manner. The first and second crosshead 1010 and 1020 may be movably connected to frame 1002 via one or more rollers to accommodate various lengths of test samples 980. The first actuation assembly 1040 is configured to apply a compressive force and/or a tension force to the test sample 980, similar to the others test assemblies described above. Fluid pressure may be supplied to the test sample 980 to pump an expander through the test sample 980 for expansion thereof while a load is applied to the bent test sample 980.

In one embodiment, the test assemblies described herein are operable to expand tubular test samples having one or more connections, such as threaded connections. The test assemblies are operable to simulate virtually all different types of downhole expansion loading conditions and scenarios. Numerous expandable tubular connection designs may thus be expanded and tested using the test assemblies. The expanded tubular connection designs may then be further tested and analyzed to define an operating envelope, including structural integrity, sealing capacity, etc., within which the connection designs may perform effectively without failure.

In one embodiment, one or more well designs may be planned according to the operating envelopes of one or more expandable tubular connections designs. In one embodiment, the drilling and completion of a well may be planned according to the operating envelope of one or more expandable tubular connections. During a wellbore operation within the well, such as a drilling operation, a completion operation, a remedial operation, the tubular connections may then be installed and expanded in the well.

In one embodiment, one or more expandable tubular connection designs may be tested using the test assemblies described herein. The tubular connection designs may be subjected to one or more loading conditions during expansion. The loading conditions may simulate the downhole loading conditions expected or anticipated during downhole expansion in one or more current or future well designs. Based on the results of the testing, one or more of the tubular connection designs may be selected for use in the well designs and may then be installed and expanded in the wells.

While the foregoing is directed to embodiments of the present invention, other and further embodiments of the invention may be devised without departing from the basic scope thereof, and the scope thereof is determined by the claims that follow.

The invention claimed is:

1. A method of expanding a tubular, comprising:

applying a pre-determined compression load to a first end of the tubular above ground;

applying a pre-determined tension load to a second end of the tubular above ground, wherein the pre-determined compression and tension loads are acting in a longitudinal direction on the tubular simultaneously before expanding the tubular;

radially expanding a portion of the tubular above ground; and maintaining the pre-determined compression and tension loads while radially expanding the portion of the tubular.

2. The method of claim 1, wherein the pre-determined compression load is applied to the tubular using a first actuation assembly.

3. The method of claim 2, wherein the pre-determined tension load is applied to the tubular using a second actuation assembly.

4. The method of claim 3, wherein the tubular is expanded by moving an expander through the tubular using the first actuation assembly.

5. The method of claim 4, wherein the pre-determined compression load is applied to a portion of the tubular ahead of the expander.

6. The method of claim 5, wherein the pre-determined tension load is applied to a portion of the tubular behind the expander.

7. The method of claim 6, further comprising supplying a fluid pressure to a chamber behind the expander to provide a thrust force to move the expander through the tubular.

8. The method of claim 7, wherein pressurization of the chamber applies an additional tension load to the portion of the tubular behind the expander, and further comprising compensating for the additional tension load to maintain the pre-determined tension load that is applied to the portion of the tubular behind the expander.

9. The method of claim 6, further comprising controlling the actuation of the first and second actuation assemblies so that the portion of the tubular ahead of the expander remains in compression with the pre-determined compression load and the portion of the tubular behind the expander remains in tension with the pre-determined tension load while the portion of the tubular is being expanded.

10. The method of claim 3, further comprising compensating for shortening of a length of the tubular during expansion by extending a rod member of the second actuation assembly that is coupled to the tubular.

11. The method of claim 1, further comprising changing the pre-determined compression and tension loads to expand another portion of the tubular.

12. The method of claim 1, further comprising preventing the tubular from shortening in length during expansion of the tubular while maintaining the pre-determined compression and tension loads.

13. The method of claim 1, further comprising bending the portion of the tubular while maintaining the pre-determined compression and tension loads during expansion.

14. The method of claim 13, expanding the portion of the tubular while maintaining a constant bend radius in the portion of the tubular.

15. An apparatus for expanding a tubular, comprising:
a first crosshead;
a second crosshead configured to support a first end of the tubular;
a third crosshead;
a frame for supporting the first, second, and third crossheads;
a first actuation assembly operable to move the first crosshead relative to at least one of the second and third crossheads to move an expander through the tubular and apply a first axial load to the tubular; and
a second actuation assembly configured to support a second end of the tubular and apply a second axial load to the tubular, wherein the first and second axial loads act in a longitudinal direction on the tubular simultaneously before and while expanding the tubular, and wherein the first axial load is different than the second axial load.

16. The apparatus of claim 15, wherein the frame includes a pair of rails.

17. The apparatus of claim 15, wherein the second and third crossheads are fixed to the frame.

18. The apparatus of claim 15, wherein the first actuation assembly includes a piston cylinder and rod that is connected to the first crosshead.

19. The apparatus of claim 15, wherein the first axial load is a compression load.

20. The apparatus of claim 15, wherein the second actuation assembly includes a piston cylinder and rod.

21. The apparatus of claim 15, wherein the second axial load is a tension load.

22. The apparatus of claim 15, further comprising a work string having a first end that is connected to the first crosshead and a second end for supporting the expander.

23. The apparatus of claim 22, wherein the work string includes a flow bore.

24. The apparatus of claim 22, wherein actuation of the first actuation assembly moves the first crosshead, which moves the work string and the expander relative to the frame.

25. The apparatus of claim 15, further comprising a controller for controlling the operation of the first and second actuation assemblies.

26. The apparatus of claim 15, wherein the second end of the tubular is secured to the second actuation assembly to prevent or compensate for shortening of a length of the tubular during expansion.

27. The apparatus of claim 15, further comprising a curved support surface for supporting and providing a bend in a tubular.

28. The apparatus of claim 15, further comprising a bending assembly having a curved support surface disposed on a support member, and one or more fixtures for forcing a tubular against the curved support surface to bend the tubular.

29. The apparatus of claim 28, wherein the curved support surface includes a plurality of plates that are releasably secured to the support member, wherein surfaces of the plates form the curved support surface.

30. A method of expanding a tubular, comprising:
applying a compression load to the tubular above ground;
applying a tension load to the tubular above ground, wherein the compression and tension loads are acting on the tubular simultaneously before expanding the tubular;
moving the tubular relative to an expander to expand a portion of the tubular above ground; and
maintaining the compression and tension loads at constant loads while the portion of the tubular is expanded.

31. The method of claim 30, wherein the compression load is applied to a portion of the tubular ahead of the expander and the tension load is applied to a portion of the tubular behind the expander.

32. A method of expanding a tubular, comprising:
applying a compression load in a longitudinal direction while applying a tension load in the longitudinal direction to one or more test samples of a tubular connection before expanding the test samples;
expanding the test samples above ground while continuously applying both the compression and tension loads to the test samples;
testing the expanded test samples for at least one of structural integrity and sealing capacity to define an operating envelope within which the tubular connection will operate without failure;
installing the tubular connection in a wellbore;
expanding the tubular connection in the wellbore; and
maintaining the tubular connection within the operating envelope defined by the testing of the expanded test samples.

33. A method of expanding a tubular, comprising:
applying a compression load to a first portion of the tubular above ground, wherein the compression load is greater than a weight of the first portion of the tubular;
applying a tension load to a second portion of the tubular above ground while applying the compression load; and then
expanding the tubular above ground by moving an expander through the tubular while applying both the compression and tension loads to the tubular.

34. A method of expanding a tubular, comprising:
applying a compression load in a longitudinal direction while applying a tension load in the longitudinal direction to one or more test samples of a tubular connection before expanding the test samples;
expanding the test samples above ground by moving an expander through the test samples while applying both the compression and tension loads to the test samples;
analyzing at least one of structural integrity and sealing capacity of the expanded test samples to define an operating envelope;
installing the tubular connection in a wellbore;
expanding the tubular connection in the wellbore; and
maintaining the tubular connection within the operating envelope.

35. The method of claim 1, wherein the tubular comprises a plurality of tubular members connected together, and further comprising changing the compression and tension loads to a different constant load after expanding one tubular connection to then expand another tubular connection of the tubular.

36. The method of claim 33, wherein the tubular comprises a plurality of tubular members connected together, and further comprising changing the compression and tension loads applied to the tubular after expanding one tubular connection to then expand another tubular connection of the tubular.

37. The method of claim 33, further comprising extending a rod member from a piston cylinder that is coupled to the tubular to compensate for shortening of a length of the tubular during expansion.

38. A method of expanding a tubular, comprising:

applying a compression load in a longitudinal direction while applying a tension load in the longitudinal direction to one or more test samples of a tubular connection before expanding the test samples;

expanding the test samples above ground by moving an expander through the test samples while applying both the compression and tension loads to the test samples;

defining an operating envelope including at least one of structural integrity and sealing capacity within which the expanded test samples perform without failure;

installing the tubular connection in a wellbore; and expanding the tubular connection in the wellbore.

39. A method of expanding a tubular having an intermediate location between a first end and a second end of the tubular, comprising:

applying a compression load in a longitudinal direction to the first end of the tubular above ground before expanding the tubular;

applying a tension load in a longitudinal direction to the second end of the tubular above ground before expanding the tubular; and radially expanding the tubular above ground while applying the compression and tension loads to the tubular, wherein the entire portion of the tubular between the first end and the intermediate location is in compression, and wherein the entire portion of the tubular between the second end and the intermediate location is in tension.

40. The method of claim 39, wherein the intermediate location between the first end and the second end is a location where an expander contacts and expands the tubular.

41. The method of claim 39, further comprising extending a rod member that is coupled to the tubular from a piston cylinder to compensate for shortening of a length of the tubular during expansion.

42. The method of claim 30, wherein the tubular comprises a plurality of tubular members connected together by a plurality of tubular connections, and further comprising changing each of the compression and tension loads to a different constant load after expanding one tubular connection to then expand another tubular connection.

43. The apparatus of claim 15, wherein the second actuation assembly is actuatable independent from the first actuation assembly.

44. The apparatus of claim 15, wherein the first axial load and the second axial load are applied in opposite directions.

* * * * *